US007724221B2

(12) United States Patent
Angele et al.

(10) Patent No.: US 7,724,221 B2
(45) Date of Patent: May 25, 2010

(54) BISTABLE NEMATIC LIQUID CRYSTAL DISPLAY METHOD AND DEVICE

(75) Inventors: Jacques Angele, Malakoff (FR); Philippe Martinot-Lagarde, Marcoussis (FR); Romain Vercelletto, Poissy (FR)

(73) Assignee: NEMOPTIC, Magny les Hameaux (FR)

( * ) Notice: Subject to any disclaimer, the term of this patent is extended or adjusted under 35 U.S.C. 154(b) by 1202 days.

(21) Appl. No.: 10/545,940

(22) PCT Filed: Feb. 19, 2004

(86) PCT No.: PCT/IB2004/001028

§ 371 (c)(1),
(2), (4) Date: Aug. 16, 2005

(87) PCT Pub. No.: WO2004/075156

PCT Pub. Date: Sep. 2, 2004

(65) Prior Publication Data

US 2006/0152458 A1 Jul. 13, 2006

(30) Foreign Application Priority Data

Feb. 20, 2003 (FR) ..... 03 02074

(51) Int. Cl.
*G09G 3/36* (2006.01)

(52) U.S. Cl. ..... 345/87; 345/94; 345/99; 349/179

(58) Field of Classification Search ..... 345/87–100, 345/204–210; 349/76, 77, 169, 177–179, 349/184–186
See application file for complete search history.

(56) References Cited

U.S. PATENT DOCUMENTS

| | | | | |
|---|---|---|---|---|
| 6,100,866 | A | 8/2000 | Surguy | |
| 6,154,190 | A | 11/2000 | Yang et al. | |
| 6,278,429 | B1 * | 8/2001 | Ruth et al. | 345/94 |
| 6,327,017 | B2 | 12/2001 | Lelidis | |
| 6,351,256 | B1 * | 2/2002 | Jones et al. | 345/94 |
| 6,768,481 | B2 * | 7/2004 | Ozawa et al. | 345/87 |
| 7,068,250 | B2 * | 6/2006 | Jones | 345/87 |
| 2003/0030612 | A1 * | 2/2003 | Yip et al. | 345/89 |
| 2004/0145548 | A1 * | 7/2004 | Miller, IV | 345/87 |

FOREIGN PATENT DOCUMENTS

| | | |
|---|---|---|
| FR | 2740894 | 5/1997 |

(Continued)

OTHER PUBLICATIONS

"Nemoptic's bistable nematic liquid-crystal technology", I Dozov, Information Display, Palizades Institute for Research Services, New York, NY Jan. 2002, pp. 10-12.

(Continued)

*Primary Examiner*—Kimnhung Nguyen
(74) *Attorney, Agent, or Firm*—Blakely, Sokoloff, Taylor & Zafman LLP

(57) ABSTRACT

The present invention provides a display device comprising a bistable nematic liquid crystal matrix screen with breaking of anchoring, the device being characterized in that it includes addressing means suitable for generating and applying control signals to each pixel of the matrix screen, the control signals having sloping rising edges presenting a gradient lying in the range 0.5 V/μs to 0.0001 V/μs.

49 Claims, 27 Drawing Sheets

FOREIGN PATENT DOCUMENTS

| | | |
|---|---|---|
| FR | 2808890 | 11/2001 |
| WO | WO 94/78665 | 8/1994 |

OTHER PUBLICATIONS

"Matrix Addressing of A O DEG-360 DEG Bistable TWist Cell" 1997 SID International Symposium Digest of Technical Papers, Boston, May 13-15, 1997, SID Int'l Symposium Digest of Technical papers, Santa Ana, vol. 28, pp. 29-32.

"The BiNem technology", Jan. 14, 2004, Neoptic Magny Les Hameaux, France, XP002289636, p. 9.

"Ultra Low Power Bright Reflective Displays using BiNem Technology Fabricated by Standard Manufacturing Equipment", Int'l Proceedings of the SID. Digest of Technical Papers society for Information Display, L.A., US, 2002 pp. 30-33.

* cited by examiner

BiNem screen principles

Example of a pixel signal for switching to T

Example of a pixel signal for switching to U

Example of a two-level pixel signal
Texture selected as a function of the value P2 of the second level of the pulse applied to the terminals of the pixel Multiplexed matrix screen Examples of row, column, and pixel signals in multiplexed mode
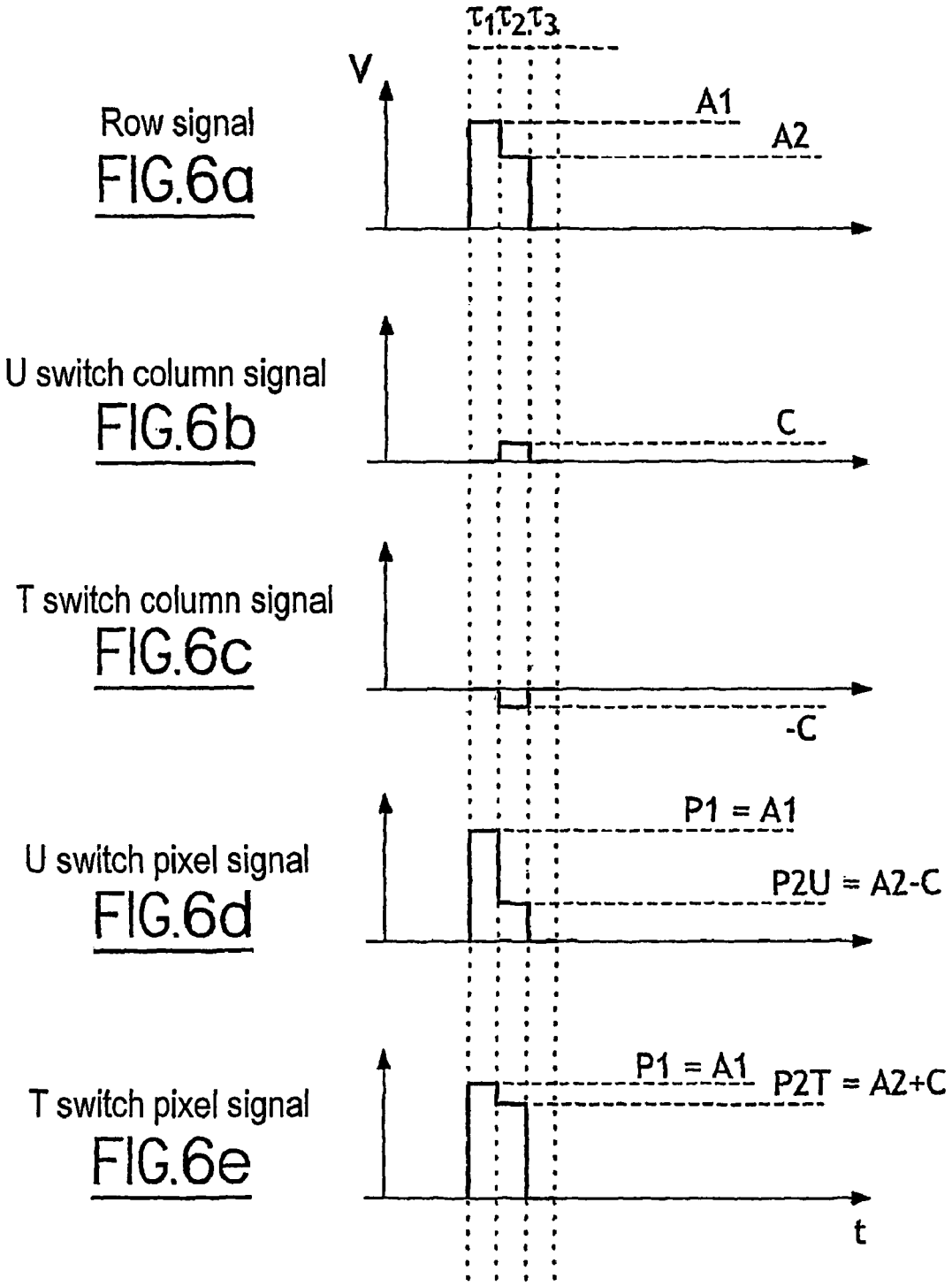

BiNem addressing in multiplexed mode
Column signal a short duration squarewave pulse
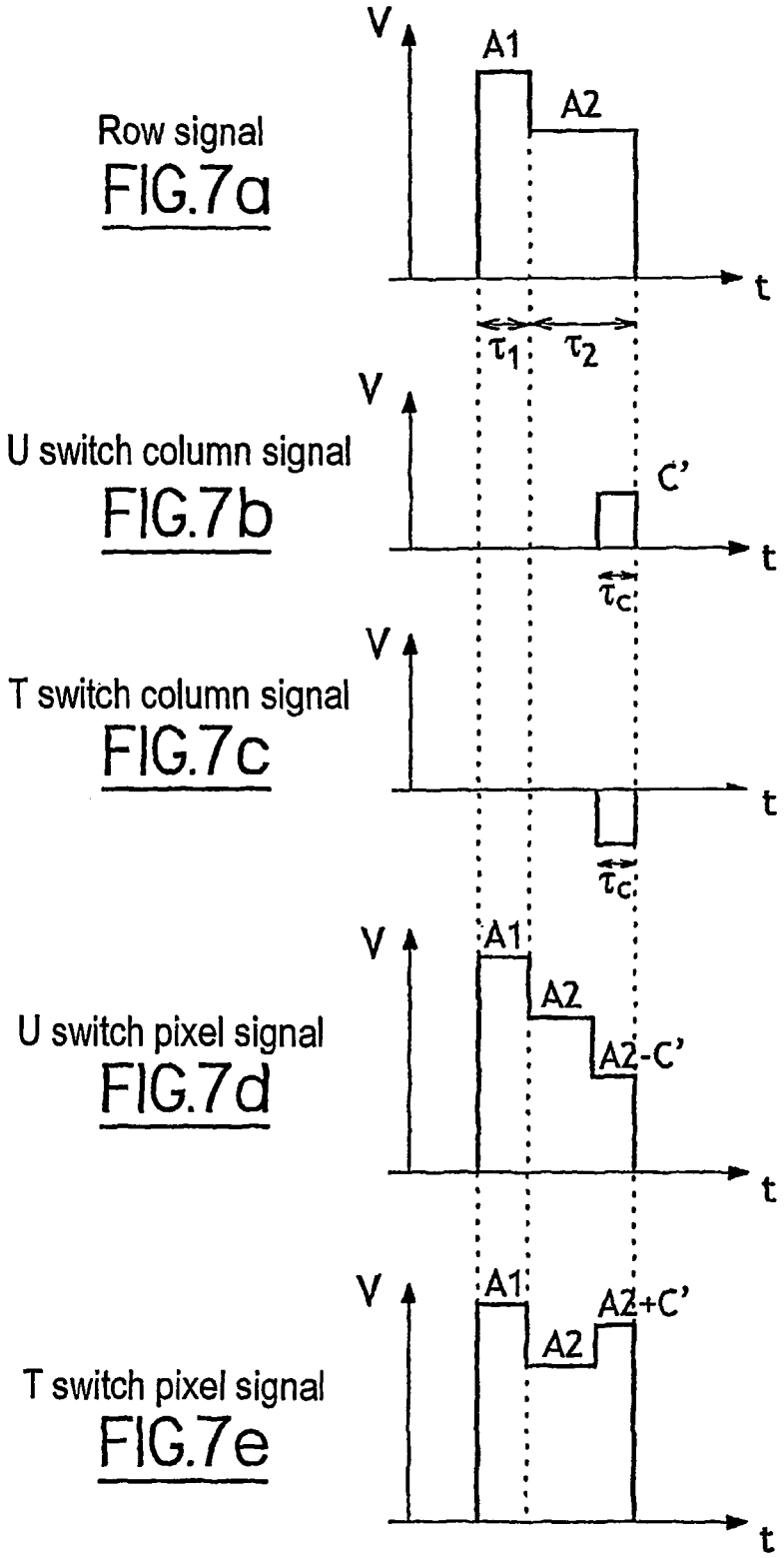

BiNem addressing in multiplexed mode
Column signal a short duration ramp

Row signal

U switch column signal

T switch column signal

U switch pixel signal

T switch pixel signal

BiNem addressing in multiplexed mode
Column signal a short duration staircase
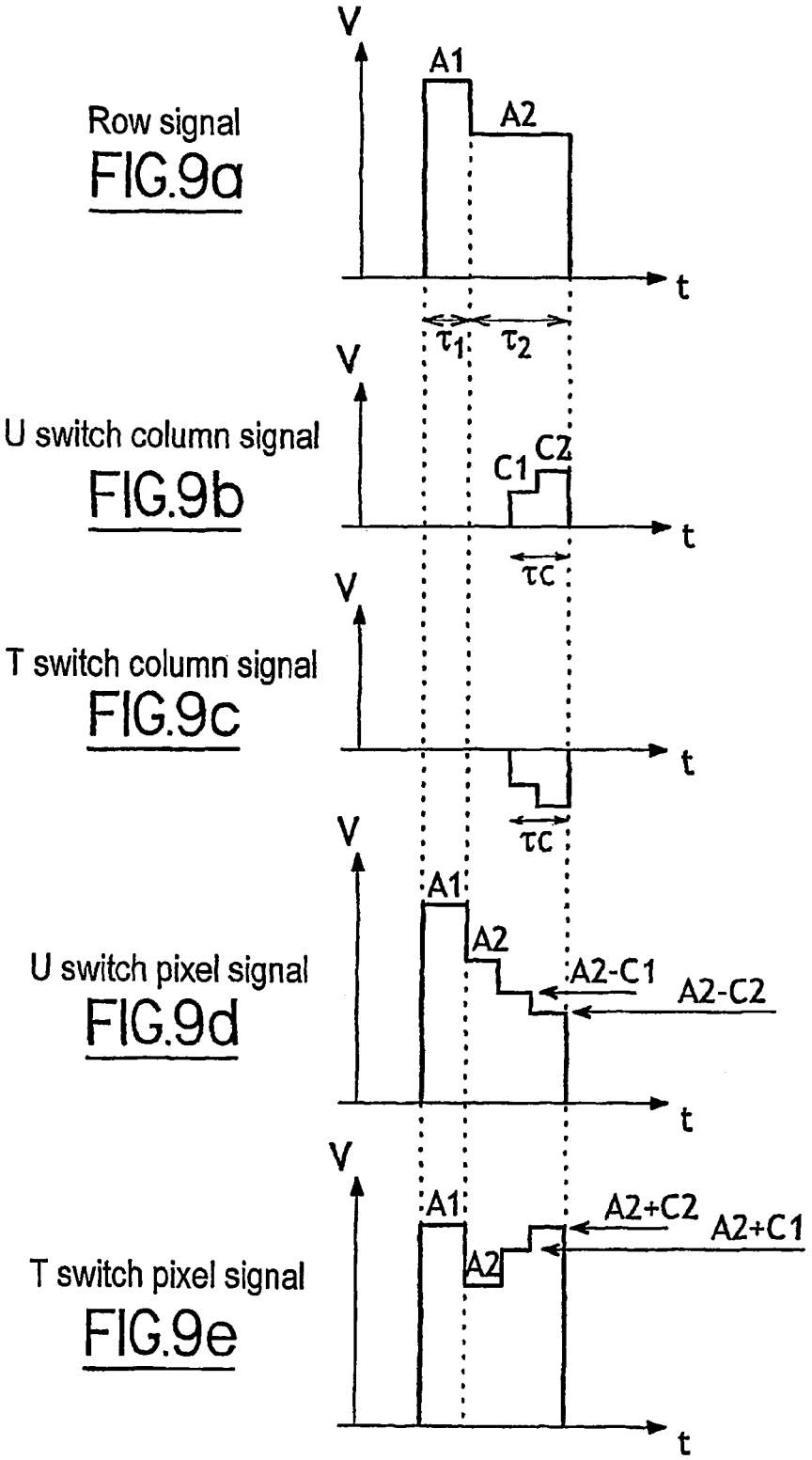

Pixel signal in variant 1 of the invention - switch to U

Pixel signal in variant 1 of the invention - switch to T

BiNem row signal in multiplexed mode in variant 1 of the invention

BiNem row signal in multiplexed mode in variant 2 of the invention superposed on variant 1

Pixel signal in variant 2 of the invention superposed on variant 1 - switch to U Pixel signal in variant 2 of the invention superposed on variant 1 - switch to T Another example of a column signal applicable to the invention Pixel signals using the row signal of Figure 12 (variant 1 of the invention) together with the column signal of Figure 16 switch to U switch to T

Row signal in variant 1, with a mean value of zero using option 1

Row signal in variant 1, with a mean value of zero using option 2

Example of row, column, and pixel signals in a BiNem display using a voltage VM to reduce row driver excursion with:
VM = VM1 for the first stage of symmetrification, and
VM = VM2 for the second stage of symmetrification Addressing with time overlap of row pulses applied to variant 1 of the invention and with a squarewave column signals Equivalent electrical circuit of a BiNem pixel having a squarewave voltage pulse applied thereto of amplitude A and frequency f Block diagram of a display module for a contactless smart card FIG.29
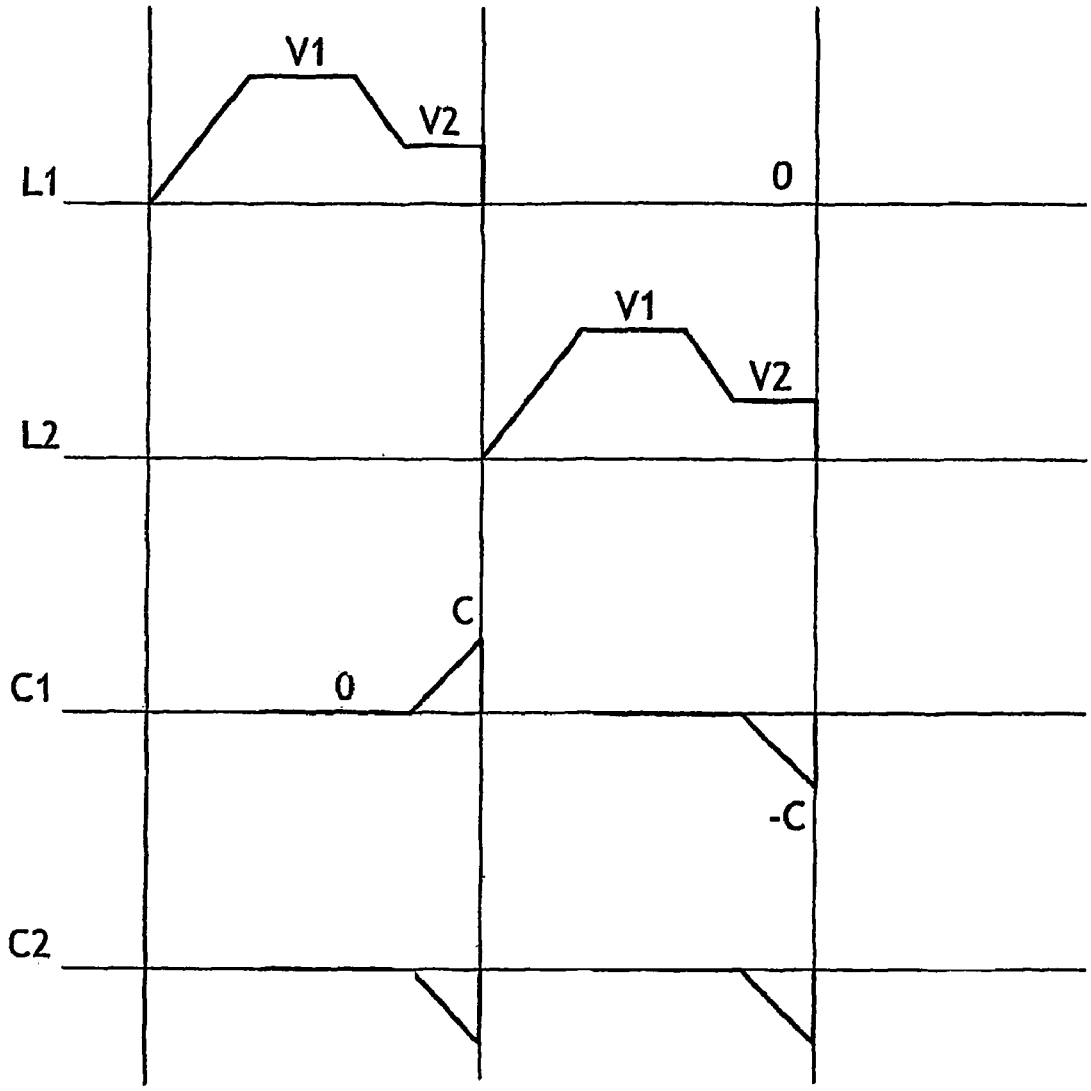
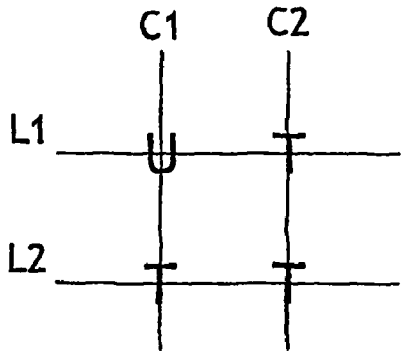

BISTABLE NEMATIC LIQUID CRYSTAL DISPLAY METHOD AND DEVICE

TECHNICAL FIELD

The present invention relates to the field of liquid crystal display devices, and more particularly it relates to a device and a method for controlling the switching of a bistable nematic display.

OBJECT OF THE INVENTION

A general object of the present invention is to improve the bistable display devices described in document [1]. Those devices are generally referred to as "BiNem" devices. This terminology is used in the context of the present patent application. The structure of such devices is described in greater detail below.

PRIOR ART

Depending on the physical nature of the liquid crystal used, distinctions are drawn between devices that are nematic, cholesteric, smectic, ferroelectric, etc. In nematic displays, to which the present invention relates, a nematic crystal is used that is achiral or that is chiralized, e.g. by adding a chiral dopant. In this way, a texture is obtained that is simultaneously uniform or lightly twisted, with a chiral pitch greater than a few micrometers. The orientation and the anchoring of the liquid crystal in the vicinity of the surfaces defined by substrates are themselves defined by alignment treatments or layers applied to said substrates. In the absence of any field, this imposes a nematic texture that is uniform or lightly twisted.

Most of the devices that have been proposed and made so far are monostable. In the absence of a field, only one texture is expressed in the device. It corresponds to an absolute minimum of total cell energy. Under a field, the texture is deformed continuously and its optical properties vary as a function of the applied voltage. When the field is switched off, the nematic crystal returns again to the sole monostable texture. Amongst such systems, the person skilled in the art will recognize the modes of operation that are the most widespread for nematic displays: twisted nematics (TN); super twisted nematics (STN); electrically-controlled birefringence (ECB) nematics; vertically aligned nematics (VAN); in-plane switching (IPS) nematics; etc. . . . .

Another class of nematic displays is that of nematic displays that are bistable, multistable, or metastable. Under such circumstances, at least two distinct textures that are stable or metastable in the absence of a field can be expressed in the cell. Switching between the two states is performed by applying appropriate electrical signals. Once the image has been written, it remains stored in the absence of a field because of bistability. This memory of bistable displays is very attractive in numerous applications. Firstly it enables images to be refreshed at a slow rate (i.e. only when the image is to be changed), which is very favorable for reducing energy consumption in portable appliances. Secondly, the memory enables multiplexing to be performed at a very high ratio with image quality that is independent of the number of rows.

Description of the So-Called "BiNem" Bistable Screen (FIG. 1)

A novel bistable display is described in document [1], and is referred to as a BiNem display.

That display is shown diagrammatically in FIG. 1.

It is constituted by a chiralized or cholesteric nematic liquid crystal layer 10 placed between two plates or substrates 20, 30, at least one of which is transparent. Two electrodes 22, 32 placed on the substrates 20, 30 respectively serve to apply electrical control signals to the chiralized nematic liquid crystal 10 lying between them. The electrodes 22, 32 carry anchoring layers 24, 34 which serve to orient the liquid crystal molecules 10 in desired directions. On a master plate 20, molecule anchoring 24 is strong and slightly inclined. On the slave plate 30, anchoring is weak and flat. The anchoring 24, 34 of the molecules 10 on these surfaces 22, 32 is monostable.

The device also has an optical system.

More precisely, the left and right sides of FIG. 1 show, diagrammatically, two states, each of which is stable, and which can be occupied by the molecules of the liquid crystal, while the middle of FIG. 1 shows a broken state that is stable under a strong electric field, but that is unstable without any field. This state is occupied temporarily by the liquid crystal molecules during the process of controlling the display.

The liquid crystal has two textures shown respectively on the left and on the right of FIG. 1 which are stable without a field being applied, these textures being twisted (T) and lightly twisted or uniform (U). The angle between the anchoring direction on the master plate 20 and on the slave plate 30 is small or zero. The two textures differ by a twist having an absolute value of about 180°, and since the spontaneous pitch $p_0$ of the nematic is selected to be close to four times the thickness d of the cell ($p_0 \approx 4.d$), the energies of the textures U and T are essentially equal. With no applied field, there exists no other state of lower energy: U and T are genuinely bistable.

An advantage of the BiNem structure is that in both the U and the T textures, the molecules are almost parallel to the (planar) plates, thus making it possible to obtain a good viewing angle without any compensation film. The optical performance of the BiNem display in a reflective configuration is described, for example, in document [2].

Method of Switching Between the BiNem Textures

The two bistable textures U and T are topologically distinct. It is impossible to transform one into the other by continuous deformation of volume. Transformation from a U texture to a T texture or vice versa thus requires the anchoring on the surfaces to be broken by a strong external field or by moving a line of disinclination. This second phenomenon is much slower than the first and can be ignored, so it is not described in detail below.

To break anchoring, it is necessary to apply a field that is not less than a threshold field $E_c$. This field should be applied for a length of time that is long enough to allow the reorientation of the liquid crystal in the vicinity of the surface to reach a texture that is homeotropic, as shown diagrammatically in FIG. 1. This minimum time depends on the amplitude of the applied field, and also on the physical characteristics of the liquid crystal and of the alignment layer. The anchoring breaking voltage Vc is defined as:

$$Vc=E_c \cdot d$$

where d is the thickness of the liquid crystal cell. A typical value of Vc for a BiNem is 16 volts (V).

Anchoring is said to be "broken" when the molecules are normal to the plate in the vicinity of said surface, and the return torque exerted by the surface on the molecules is zero. When these conditions are satisfied, the nematic molecules in the vicinity of the broken surface 34 are in unstable equilibrium once the electric field is switched off, and they can return either to their initial orientation or else they can turn in the opposite direction to induce a new texture that differs from the initial texture by a twist of 180°.

The final texture is determined by the waveform of the applied electrical signal, and in particular on the way in which the signal is returned to zero. A progressive descent in the voltage of the pulse induces the U texture shown diagrammatically on the left of FIG. 1, whereas a sudden descent in the field encourages the T texture as shown diagrammatically on the right of FIG. 1. The physical mechanisms that enable switching to be performed in this way are described in document [1], for example.

Practical Implementation

In general, the switching of a liquid crystal pixel of the BiNem type is performed in two stages (a first stage of breaking anchoring, and a second stage of selecting texture):

First Stage: the Anchoring-Breaking Stage, Referenced C.

The C stage consists in applying to the slave plate 30 an electrical signal that is suitable for breaking anchoring. In general, the shorter the C stage, the greater the peak amplitude required in the applied signal.

For given amplitude and duration, the detail of the waveform of this signal (slopes, intermediate levels, . . . ) does not have a determining effect on the way the following stage takes place, providing anchoring is indeed broken.

Second Stage: the Selection Stage, Referenced S.

The voltage applied during the S stage must make it possible to select one or other of the two bistable textures: U or T. Given the effect explained above, it is the descending waveform of the electrical pulse applied to the terminals of each pixel that determines transformation to one texture or to the other.

For obtain a transformation to the T texture:

Stage C: Breaking Anchoring

During stage C in which anchoring is broken, it is necessary to apply a pulse delivering a field greater than the anchorage-breaking field on the slave plate 30 and to wait for a length of time that is needed for the molecules in the pixel to be raised as shown in the middle of FIG. 1. This breaking field is a function of the elastic and the electrical properties of the liquid crystal material 10 and of the way it interacts with the anchoring layer 34 deposited on the slave plate 30 of the cell. It varies over the range several volts to about ten volts per micrometer. The lifting time of the molecules is proportional to the rotational viscosity Y and inversely proportional to the dielectric anisotropy of the material 10 used, and also to the square of the applied field. In practice, this time can be brought down to a few microseconds for fields of about 20 volts per micrometer.

Stage S: Selecting the Texture

Thereafter, it suffices to cause the field to descend quickly, by establishing a sudden descent in the control voltage in a few microseconds or at most in a few tens of microseconds. This sudden descent in the voltage through an amplitude of not less than $\Delta V$ is such as to be capable of inducing a hydrodynamic effect of sufficient intensity in the liquid crystal. To produce the T texture, this descent $\Delta V$ must necessarily cause the applied voltage to go from a value greater than the anchoring-breaking voltage Vc to a value that is smaller than said voltage.

An example of a signal suitable for transforming to the T texture is a squarewave type signal of amplitude P1>Vc and $P1 \geqq \Delta V$. Its duration must be sufficient to break anchoring, with the descent from P1, to 0 with $P1 \geqq \Delta V$ serving to select the T texture (cf. FIG. 2).

Another example of a signal for transforming to the T texture is a signal having two levels, the signal comprising a first sequence for breaking anchoring of duration $\tau_1$ and of amplitude P1 where P1>Vc, followed by a second sequence for selection purposes of duration $\tau_2$ and amplitude P2, such that either $P2 \geqq \Delta V$ and P2>Vc, or $P1-P2 \geqq \Delta V$ and P2<Vc. The time taken by the applied field to descend must be less than one-tenth its duration or less than 30 microseconds (μs) for long pulses (pulses longer than 1 millisecond (ms)).

To obtain the U texture:

Stage C: Breaking Anchoring

During stage C of breaking anchoring, it is necessary to apply a field greater than the anchoring-breaking field on the slave plate 30 for a length of time that is sufficient to lift the molecules, as in the above-described state of writing into the T state.

Stage S: Selecting Texture

It is then appropriate to cause the applied voltage to descend slowly. Document [1] proposes two ways of achieving such a "slow descent": either the signal is a pulse of duration $\tau_1$ and amplitude P1 followed by a ramp of duration $\tau_2$ with a descent time that is longer than three times the duration of the pulse (FIG. 3), or else a staircase descent is imposed.

An example of a signal for transforming to the U texture is a signal having two levels comprising a breaking first sequence of duration $\tau_1$ and of amplitude P1 (P1>Vc) followed by a second sequence for selection purposes of duration $\tau_2$ and amplitude $\tau_2$ such that $P2<\Delta V$ and $P1-P2<\Delta V$. A staircase descent with two levels is easier to implement using digital electronics. Nevertheless, it is quite possible to devise a descent via some number of levels greater than two.

It is thus possible, merely by applying a simple signal-having two levels to the terminals of the pixel to obtain either the U texture or the T texture. The first level (P1, $\tau_1$) corresponds to the stage of breaking anchoring, while the second level (P2, $\tau_2$) enables texture to be selected by determining the value of P2. This signal is shown in FIG. 4. A value P2T corresponds to a value of P2 enabling transformation to T (for given P1), while a value P2U corresponds to a value of P2 enabling transformation to a U texture (for given P1).

Typical values: P1=20 V, P2U=7 V to 9 V, and $\Delta V$=9 V to 13 V for $\tau_1=\tau_2$=1 ms.

Addressing the BiNem by Multiplexing Multiplexing in General

For a matrix screen of medium resolution, the person skilled in the art knows that there is no question of connecting each pixel individually to an independent control electrode, since that would require one connection per pixel, which is topologically impossible once the screen becomes complex. It is possible to reduce the number of connections by making use of the multiplexing technique when the electro-optical effect used is not linear, as is the case with ordinary liquid crystal technologies. Pixels are organized in a matrix system as n groups of m pixels each. For example there are n rows and m columns for matrix screens or n digits and m digit portions for digital displays. With a sequential addressing mode, as is the usual case, one row is selected at a time, and then the following row is selected, and so on to the last row. Each time a row is selected, the column signals are applied at the same instant to all of the pixels in the row. This method enables an entire image to be addressed in a time span equal to the time required for addressing one row multiplied by the number n of rows. With this method, m+n connections suffice for addressing a screen of m×n pixels, where m is the number of columns in the matrix under consideration. Such a multiplexed matrix screen is shown in FIG. 5.

The electrical signal seen by any one pixel is the difference between the signal applied to the row and the signal applied to the column having the pixel at their intersection.

A screen based on the principle shown in FIG. 5 is said to be a "passive" screen. A row electrode is common to all of the pixels in the row and a column electrode is common to all of the pixels in the column.

The conductive electrodes must be transparent. The material used by all manufacturers is indium-doped tin oxide (ITO).

Multiplexing Applied to a BiNem

In order to be multiplexed, the pixel signal needs to be subdivided into a row signal which is common to all of the pixels, and a column signal which serves to obtain either a U texture or a T texture, depending on its sign. FIG. 6 shows an example of row and column signals enabling the appropriate pixel signal to be implemented.

The row signal (FIG. 6*a*) comprises two levels: the first delivers a voltage A1 for a time $\tau_1$, while the second delivers a voltage A2 for a time $\tau_2$. The column signal (FIG. 6*b* for transformation into U texture, and FIG. 6 for transformation into T texture) is of amplitude C and is applied solely during the time period $\tau_2$, being either positive or negative depending on whether it is desired to clear the pixel (i.e. obtain the U texture) or write to the pixel (i.e. obtain the T texture). A time $\tau_3$ extends between two row pulses. FIGS. 6*d* and 6*e* show the signals applied respectively to the terminals of a pixel that is cleared (transformation to U texture) and to the terminals of a pixel that is written (transformation to T texture).

These signals must satisfy the following conditions:

$$A1=P1;\ A2-C=P2U;\ A2+C=P2T.$$

Using the above numerical example, one possible solution is as follows:

A1=20V, A2=10.5V, C=2.5V; giving P2U=8V and P2T=13V, with $\tau_1=\tau_2=1$ ms.

Such signals are very simple and make it easy for all of their parameters to be adjusted to the characteristics of the screen.

The principle of switching based on the waveform of the descending edge of the pixel signal is specific to a BiNem.

In order to accommodate problems of degradation by electrolysis suffered by certain liquid crystal materials when they are subjected to a direct current (DC) voltage, it is often advantageous to apply signals to the pixels that have a mean value of zero or nearly zero. Techniques for converting the theoretical signals of FIG. 6 into symmetrical signals having a mean value of zero are described in document [3].

Reducing the Duration of the Column Signal

In order to reduce interfering signals while addressing a BiNem, document [3] recommends reducing the duration of the column signal to a duration that is shorter than that of the second level in the row addressing signal. This reduction can also be associated with a modification to its waveform. An example of the signals obtained by reducing the duration of the column signal, where said signal is a square waveform signal of amplitude C', is shown diagrammatically in FIG. 7. An example of the signals obtained by reducing the duration of the column signal, said signal having a ramp-shaped waveform of maximum amplitude C", is shown diagrammatically in FIG. 8. An example of the signals obtained by reducing the duration of the column signal, where said signal has a staircase waveform of amplitudes C1 and C2 is shown diagrammatically in FIG. 9.

BRIEF SUMMARY OF THE INVENTION

An object of the invention is to propose novel means for improving the state of the art.

In the context of the present invention, this object is achieved by a display device comprising a bistable nematic liquid crystal matrix screen with breaking of anchoring, the device being characterized in that it includes addressing means suitable for generating and applying control signals to each pixel of the matrix screen, the control signals having sloping-rising edges presenting a gradient lying in the range 0.5 volts per microsecond (V/μs) to 0.0001 V/μs.

The advantages of such addressing signals having slopes replacing the conventional sharp rising edges, usable in particular in multiplexed mode, and in simultaneous mode, are described below.

In the context of the present invention, the term "matrix" screen should not be considered as being limited solely to a regular arrangement of pixels in rows and columns. It covers any arrangement of pixels in the form of n groups of m associated elements, e.g. n digits each made up of m elements.

The present invention also provides a method of electrically controlling a bistable nematic liquid crystal matrix screen with breaking of anchoring, which method is characterized in that it comprises generating and applying to the matrix screen addressing and control signals that have sloping rising edges.

According to an advantageous characteristic of the present invention, the screen of the present invention uses two textures, one of which is uniform or lightly twisted in which the molecules are at least substantially parallel to one another, and the other of which differs from the first by a twist of the order of plus or minus 180°.

Other characteristics, objects, and advantages of the invention will appear on reading the following detailed description made with reference to the accompanying drawings, given as non-limiting examples, and in which:

FIG. 1, described above, is a diagram of a prior art BiNem screen;

FIG. 2, described above, shows an example of squarewave pixel signal for switching such a BiNem screen into the T state;

FIG. 3, described above, shows an example of a pixel signal having a sloping descending edge for switching such a BiNem screen into the U state;

FIG. 4, described above, shows an example of a pixel signal having two levels, enabling the texture of a pixel in such a BiNem screen to be selected as a function of the value P2 of the second level of the pulse applied to the terminals of the pixel;

FIG. 5, described above, is a diagram showing a multiplexed matrix screen;

FIG. 6, described above, shows an example of row and column signals for a pixel in a multiplexed BiNem screen;

FIGS. 7, 8, and 9, described above, show three variant examples of row and column signals for a pixel in a multiplexed BiNem screen, in which the duration of the column signal is reduced in order to reduce interfering signals;

Figure 12:
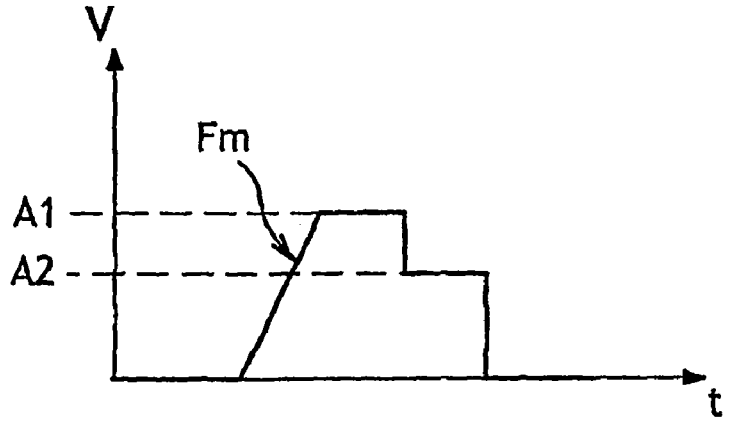
FIG. 12 is a diagram of a row signal in accordance with the present invention, in this context.
Figure 16:
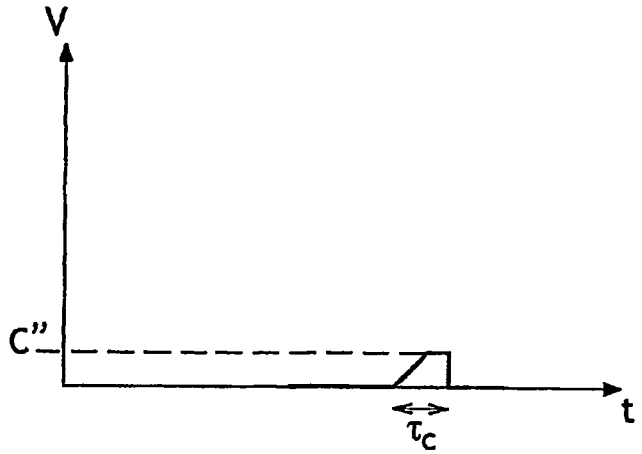
FIG. 16 is a diagram of a column signal in accordance with a variant of the present invention.
Figure 17A:
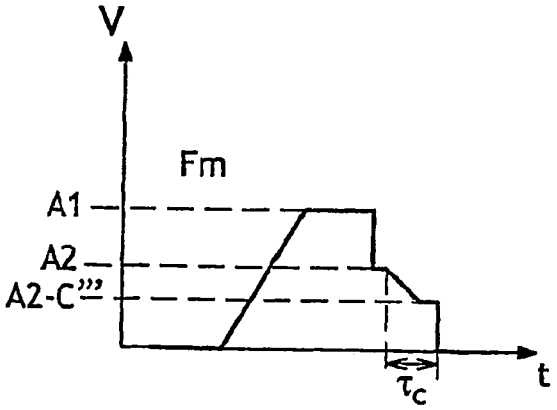
Figure 17B:
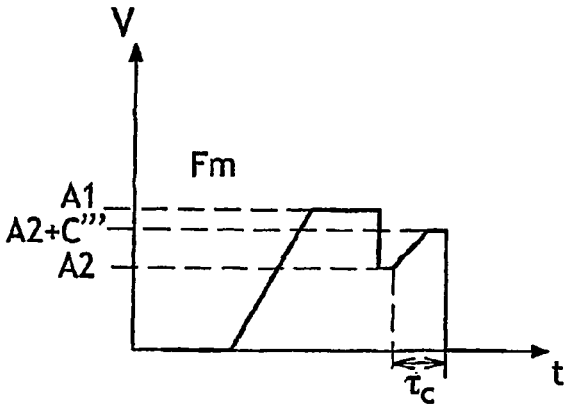
Figure 18:
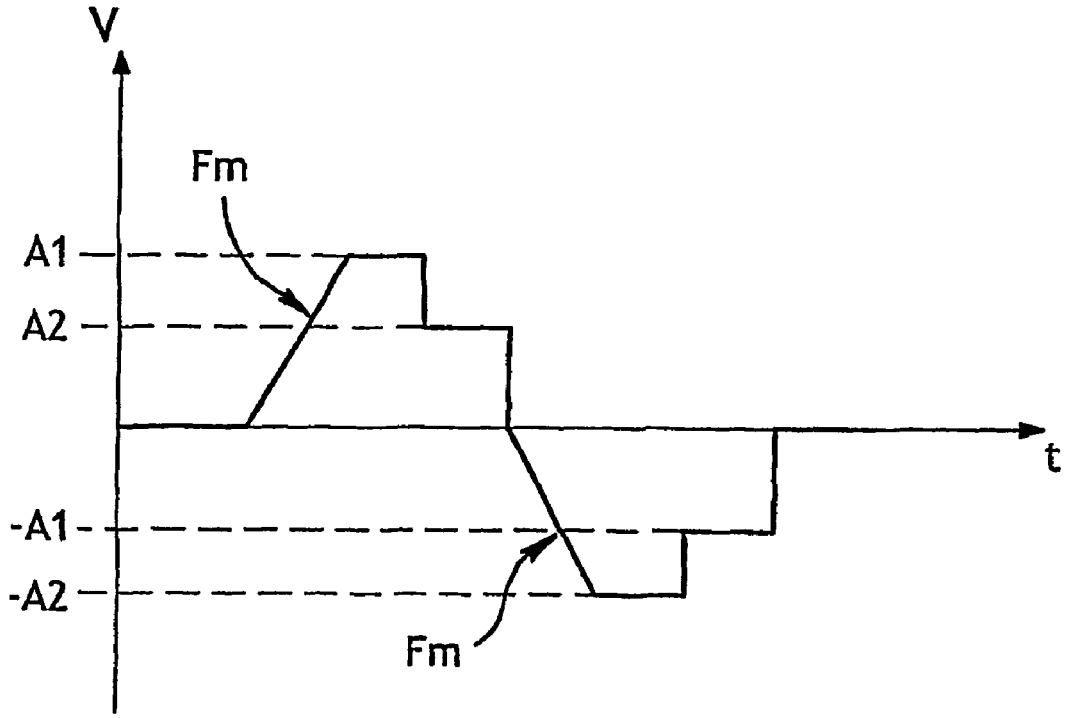
Figure 19:
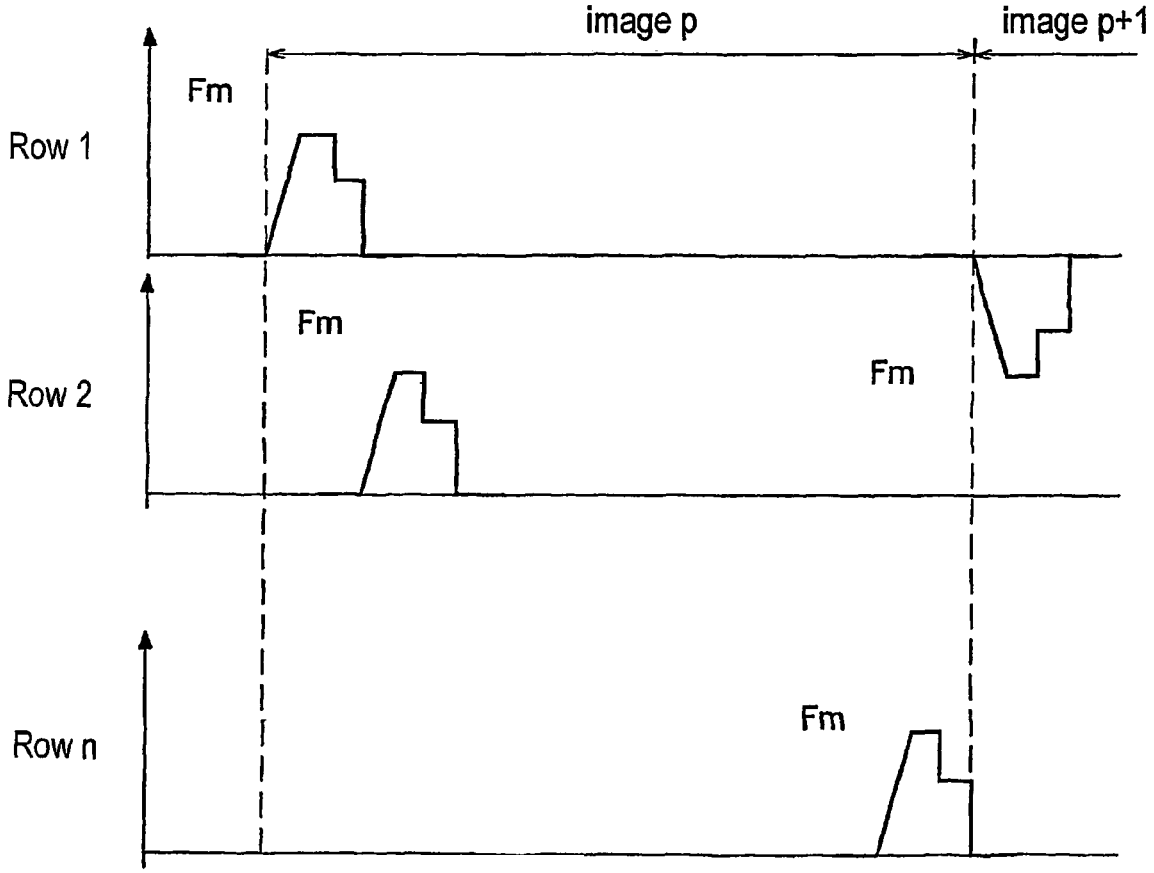
Figure 21:
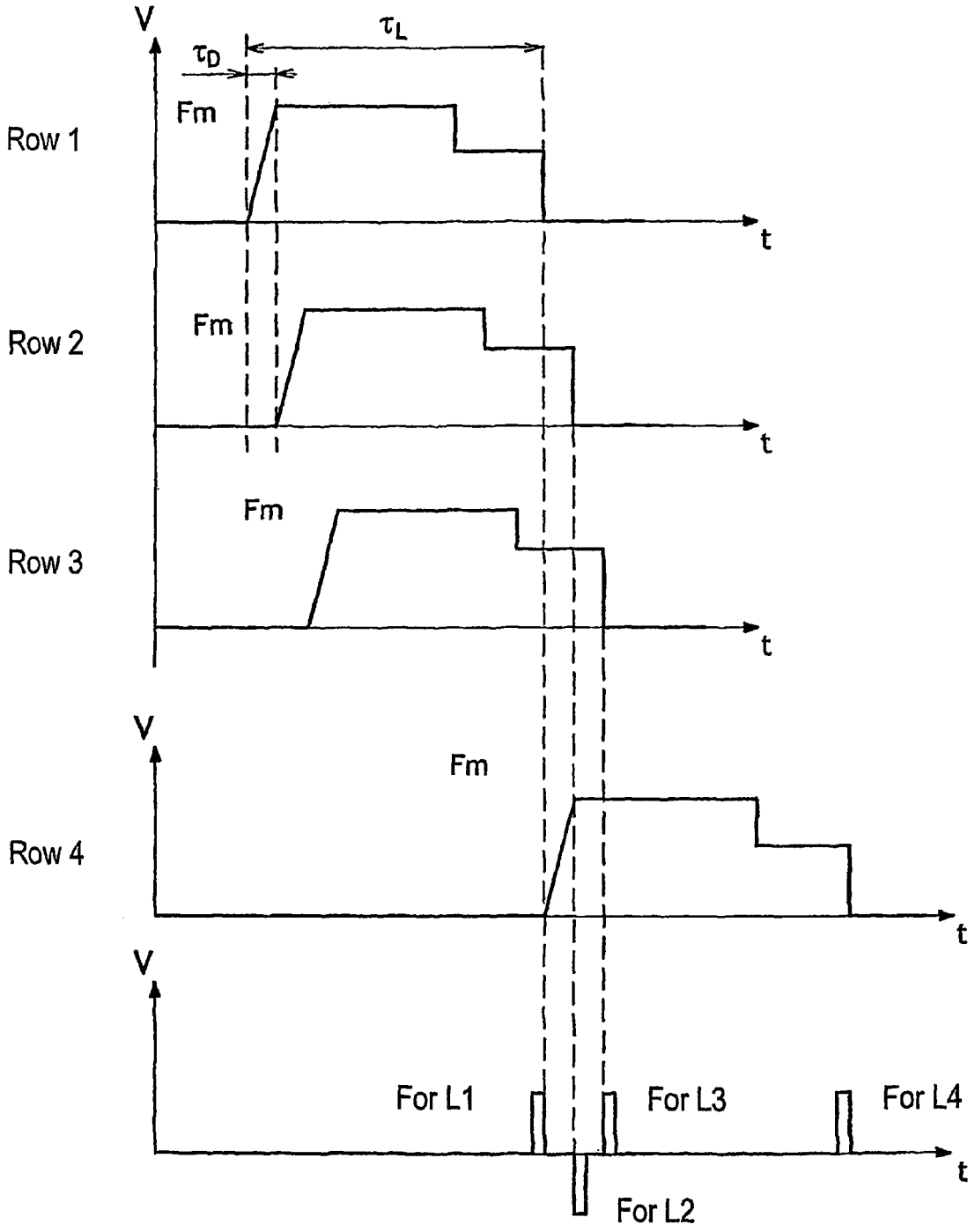
Figure 22:
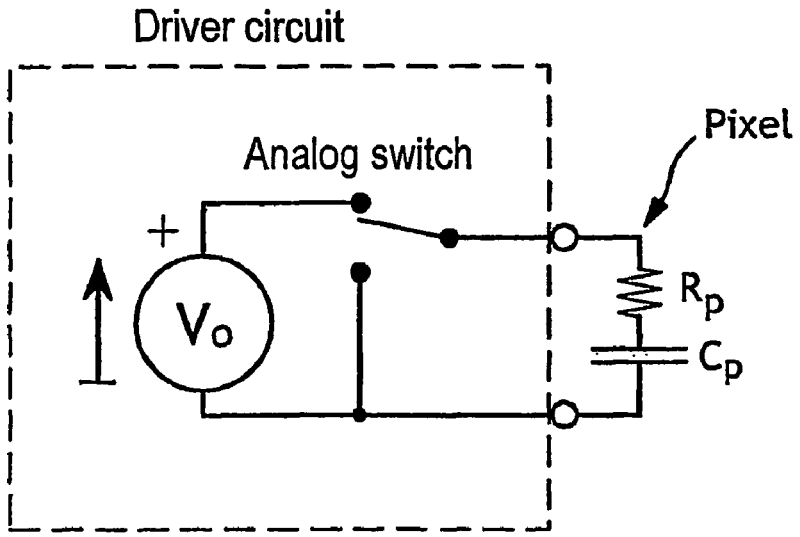
Figure 23:
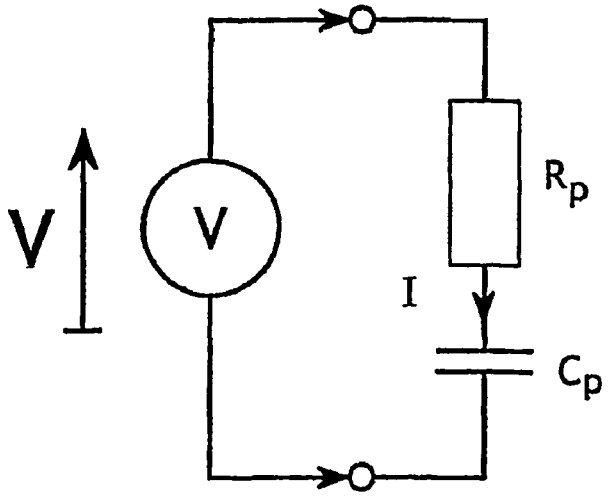
Figure 24:
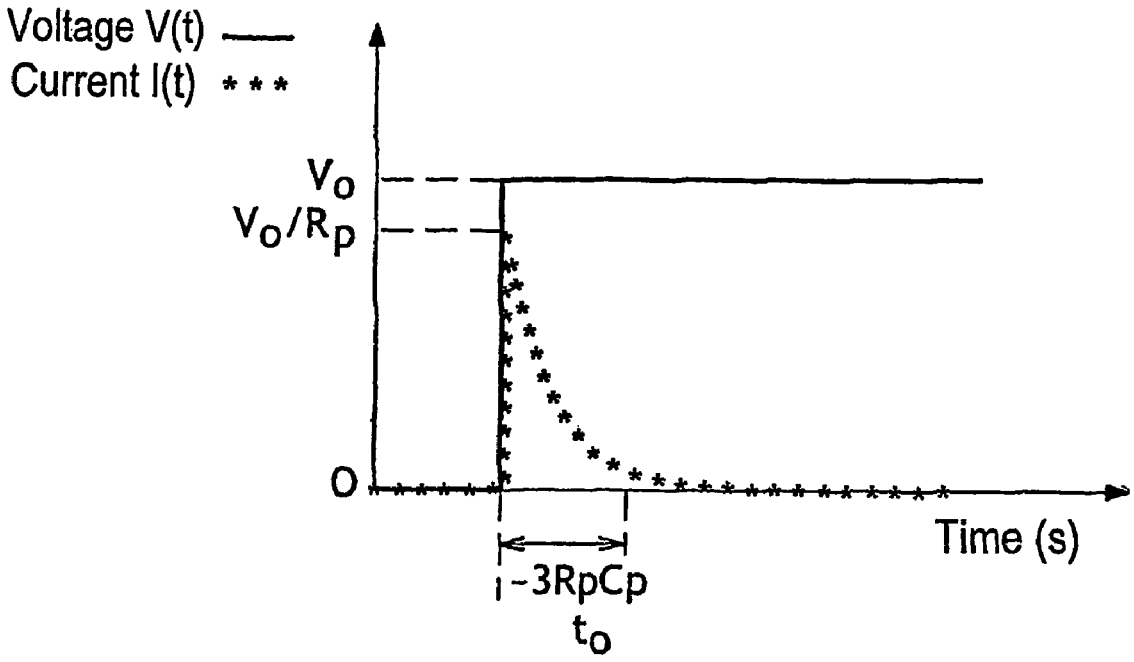
Figure 25:
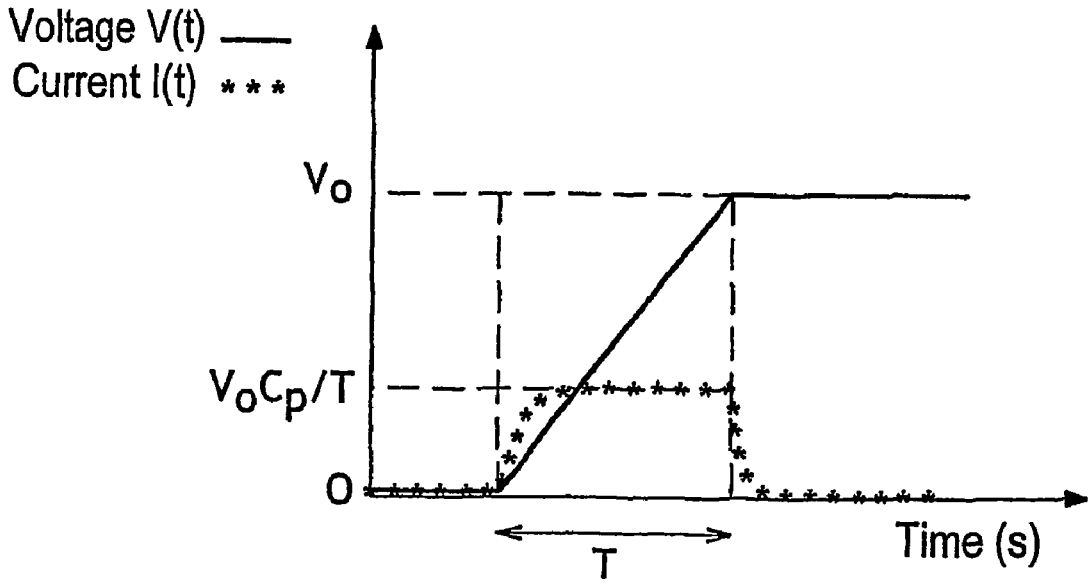
Figure 26:
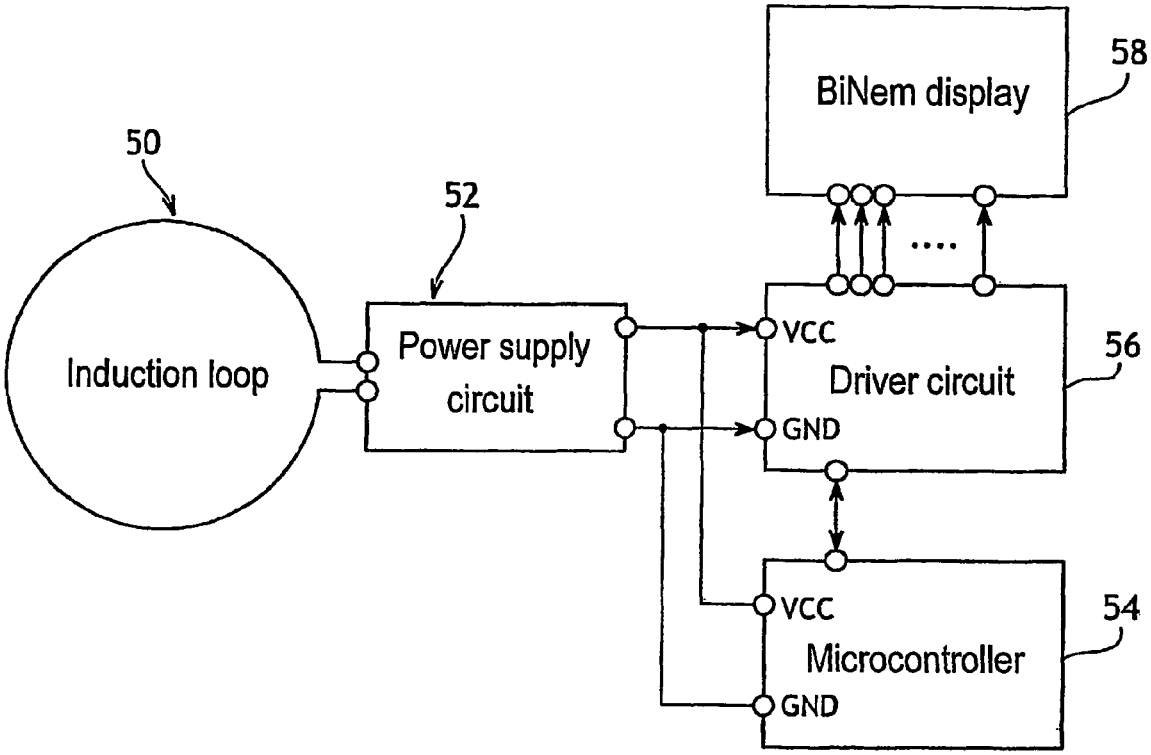
Figure 27:
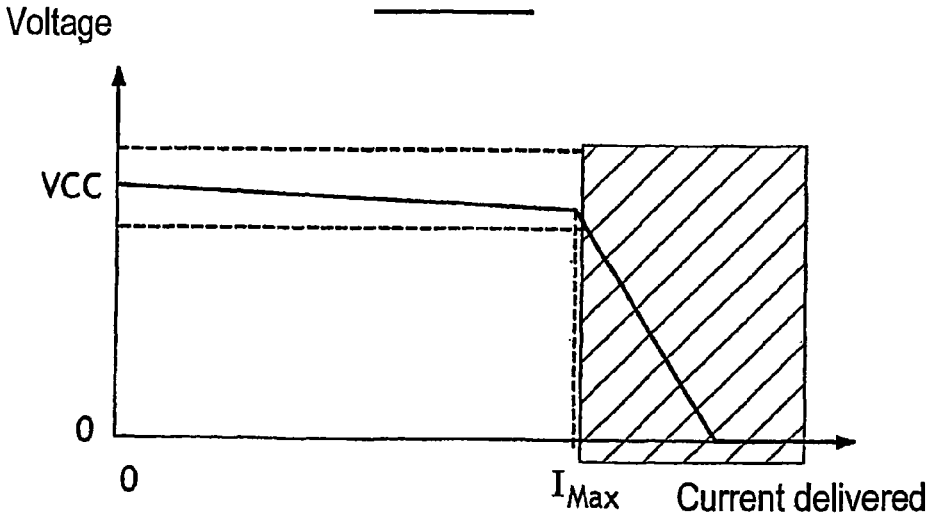
Figure 28:
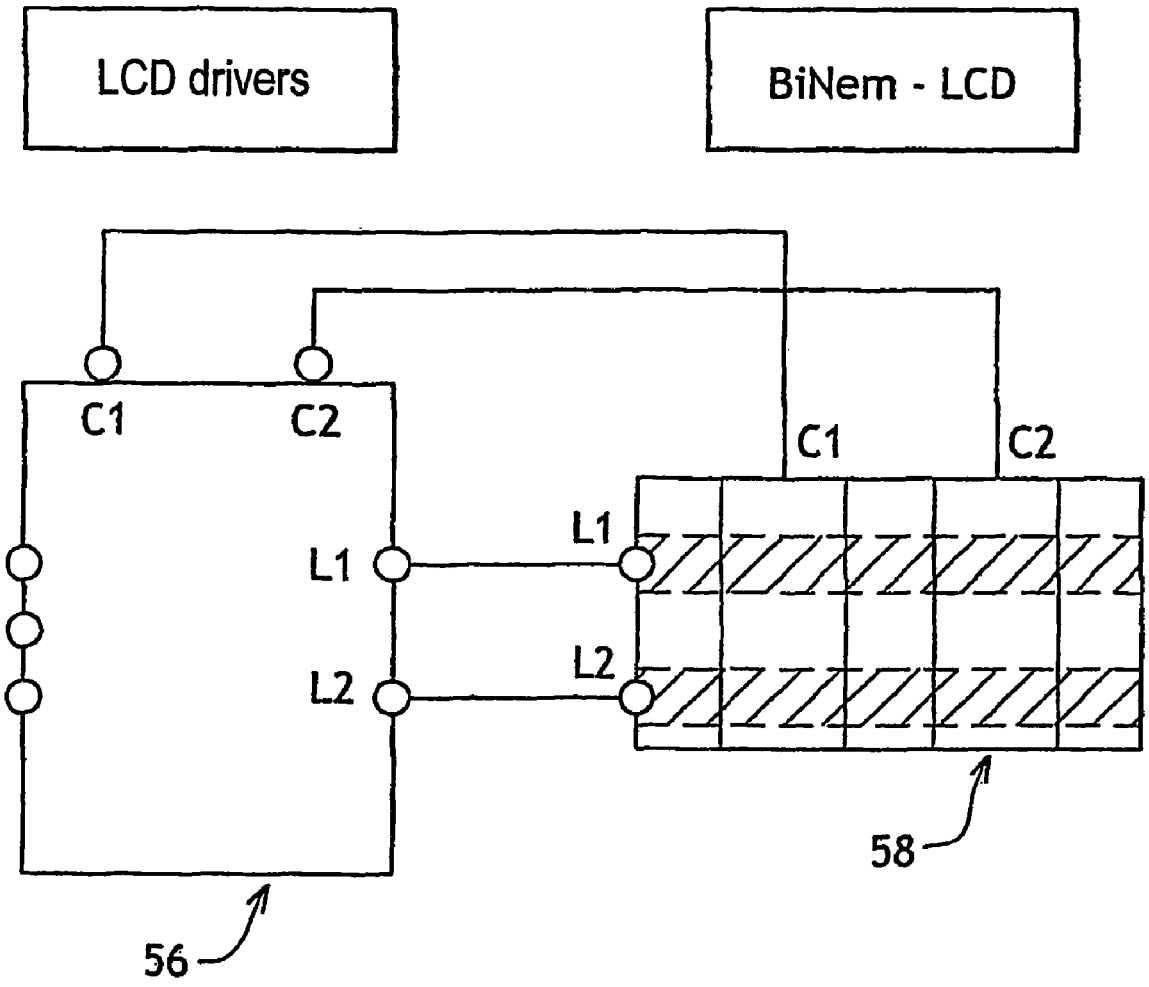
Figure 30:
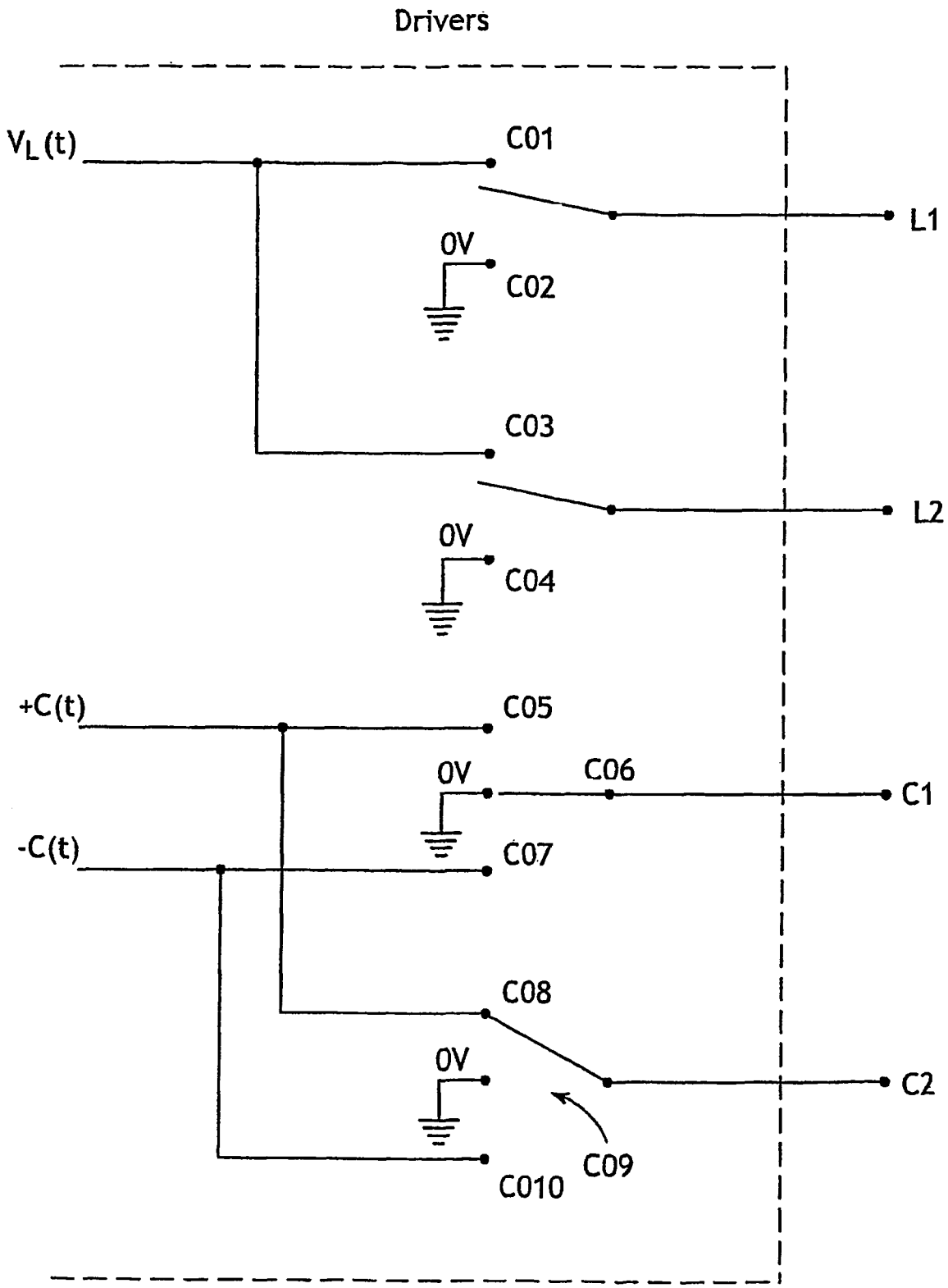
Figure 31:
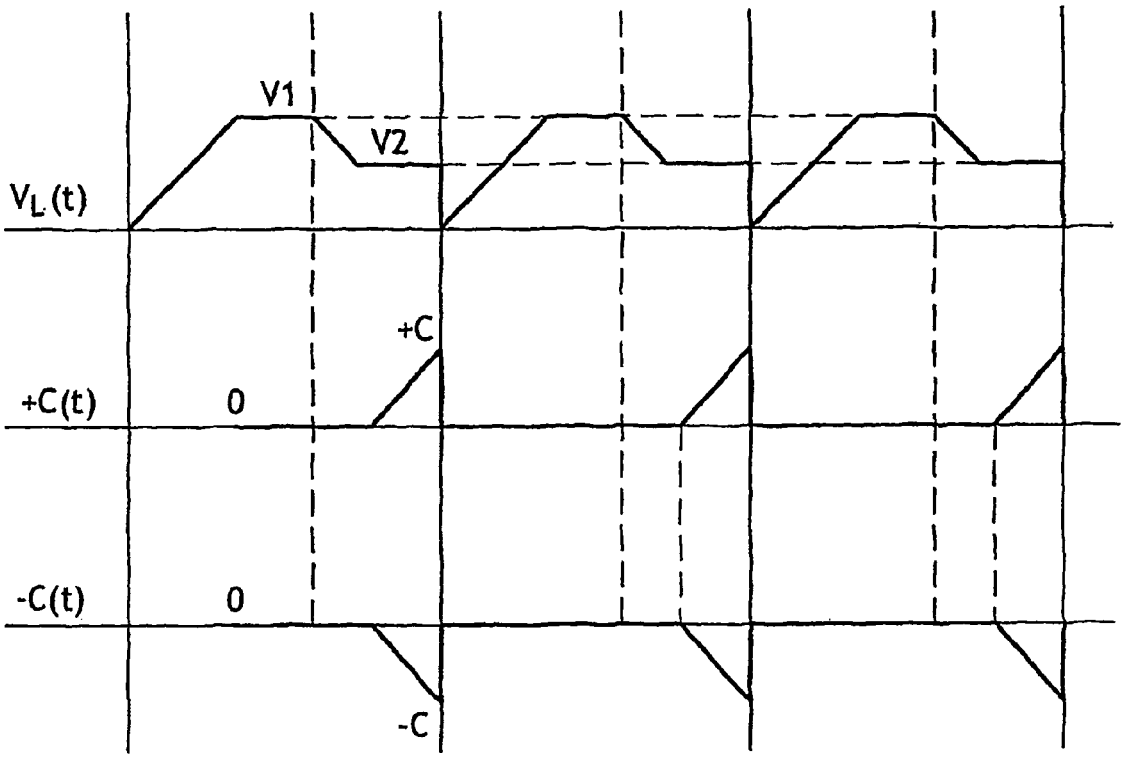
Figure 34:
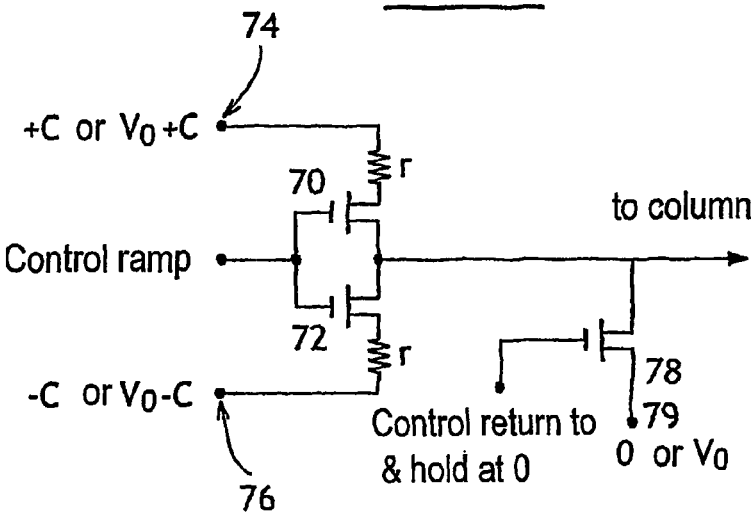
Figure 32:
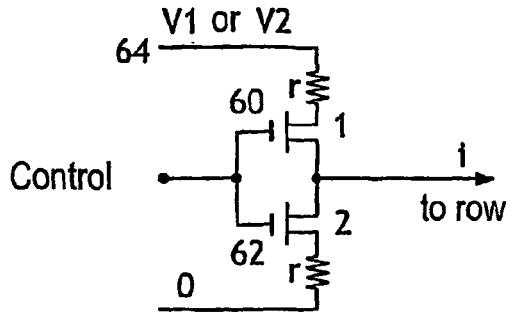
Figure 33A:
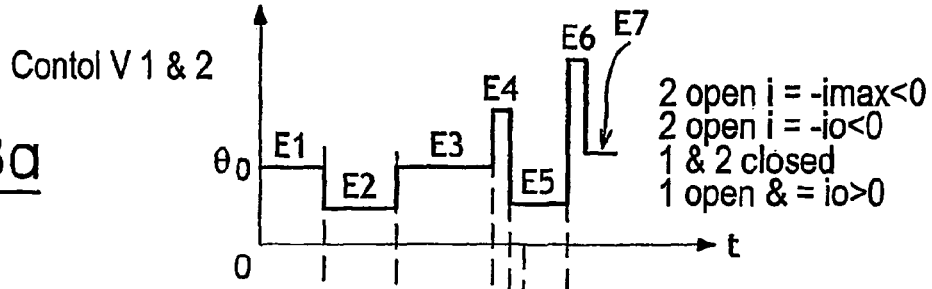
Figure 33B:
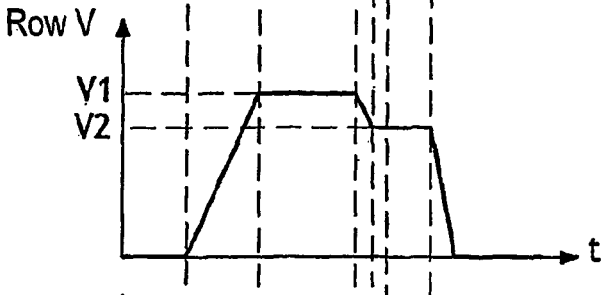
Figure 33C:
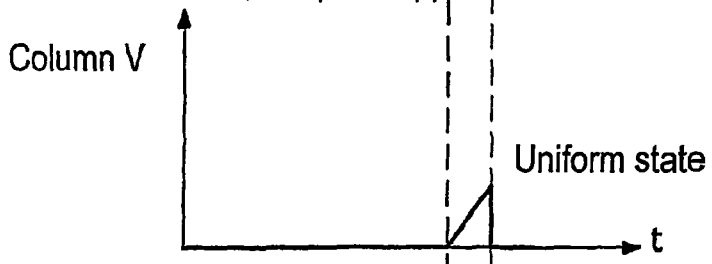
Figure 33D:
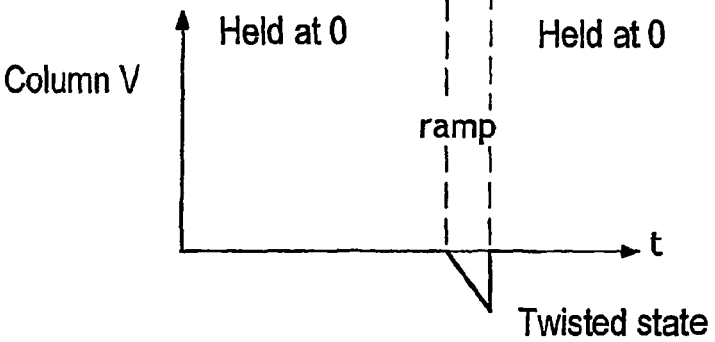
Figure 35:
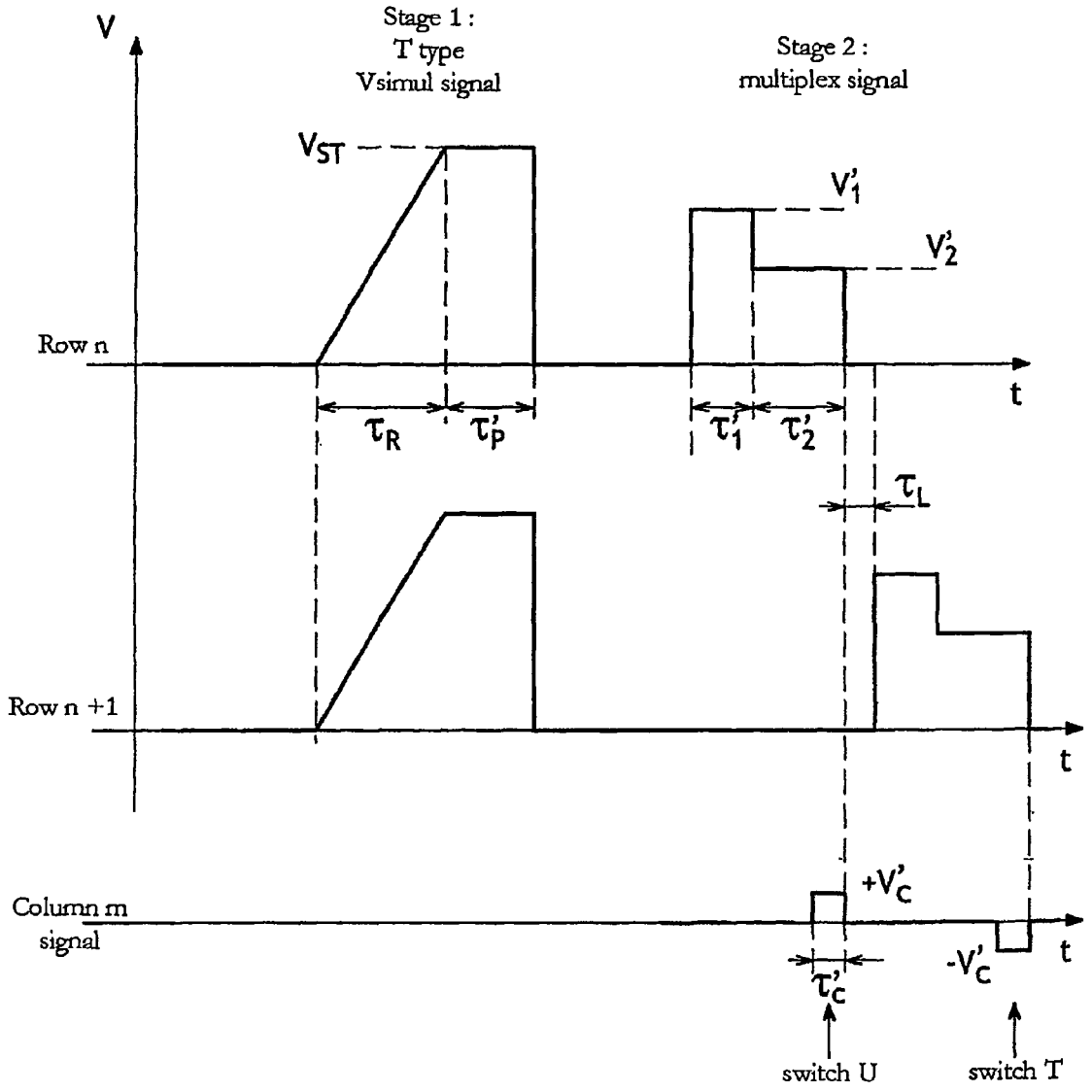
Figure 36:
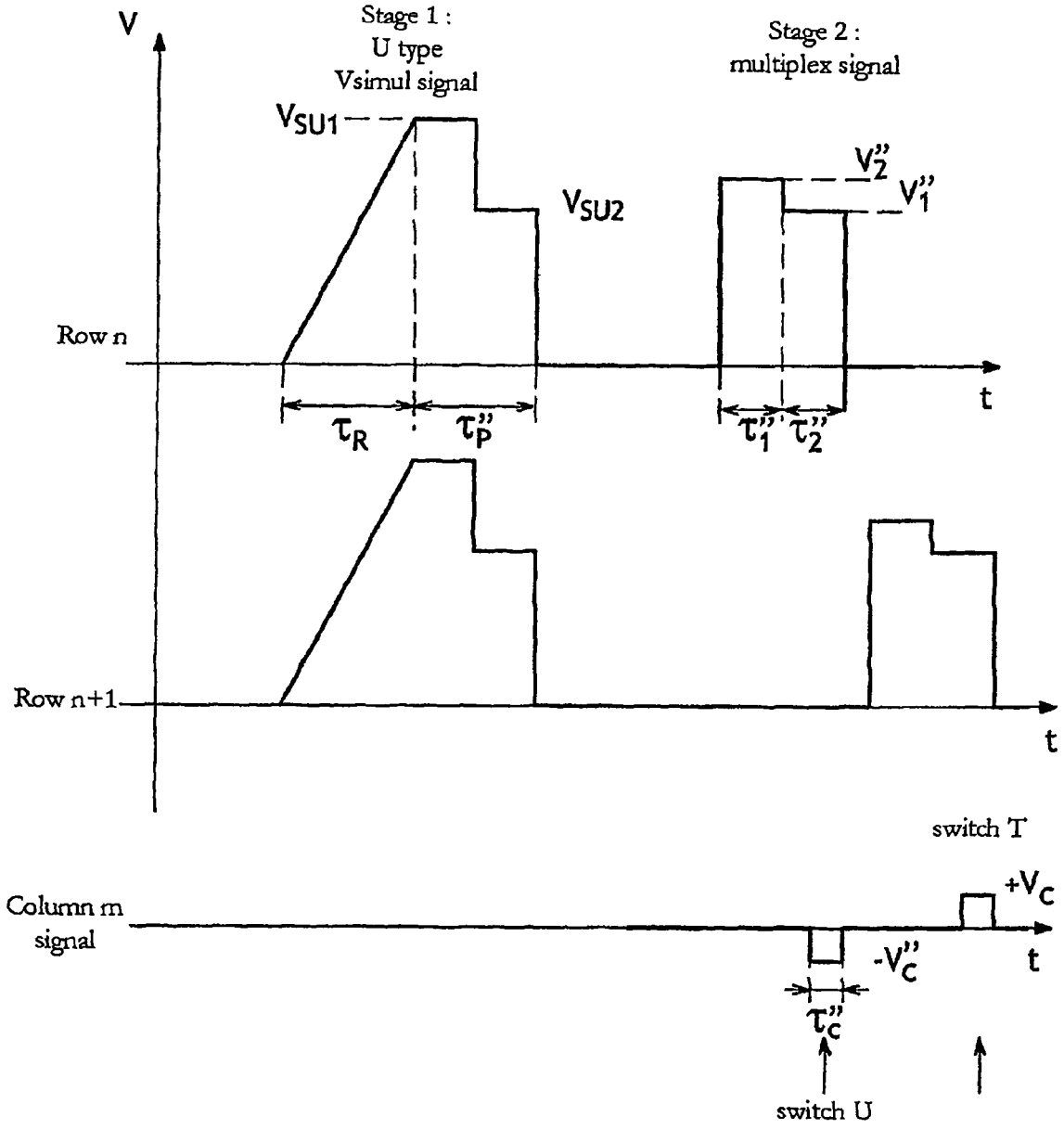

FIGS. 17*a* and 17*b* show pixel signals using the row signal of FIG. 12 and the column signal of FIG. 16, showing respectively a positive signal to obtain the U state and a negative signal to obtain the T state;

FIG. 18 is a diagram of a row signal having a mean value of zero obtained by alternately inverting polarity, in accordance with a variant of the present invention;

FIG. 19 is a diagram of another variant in accordance with the present invention presenting a mean value of zero by alternately inverting polarity from one row to the next;

FIG. 20 shows examples of row, column, and pixel signals for a display in accordance with the present invention using a voltage $V_M$ so as to reduce the excursion of the row driver;

FIG. 21 shows four row signals in accordance with the present invention in the context of time overlap between row pulses, associated with a column signal of squarewave shape;

FIG. 22 is an equivalent circuit diagram for a BiNem pixel receiving a conventional squarewave of amplitude A and frequency f;

FIG. 23 is an equivalent circuit diagram for a pixel for a conventional applied squarewave signal having a zero rise time;

FIG. 24 shows said conventional squarewave signal net of the pulse corresponding to charging the pixel;

FIG. 25 shows the current flowing through a pixel with a control signal in accordance with the present invention presenting a sloping rising edge;

FIG. 26 is a block diagram of a display module having no energy storage means;

FIG. 27 is a diagram showing the voltage drop that is liable to occur in such a module when the current drawn exceeds the maximum acceptable value;

FIG. 28 is a diagram of a 2×2 display and the associated driver module;

FIG. 29 is an arbitrary diagram of positive unipolar multiplexing for rows and bipolar multiplexing for columns, with a constant superposed voltage $V_M$, for use with such a display;

FIG. 30 represents the switching control circuit for said display;

FIG. 31 shows varying analysis signals for the circuit;

FIG. 32 shows a control circuit in accordance with a variant of the present invention, for generating the row signals;

FIG. 33 shows respectively in FIG. 33*a* a transistor control signal, in FIG. 33*b* a resulting row signal, and in FIGS. 33*c* and 33*d* an associated column signal for obtaining a uniform effect or a twisted effect;

FIG. 34 is a diagram showing a control circuit in accordance with a variant of the present invention, for generating column signals;

FIG. 35 shows row and column signals for a display addressed in a mode having two levels in accordance with the present invention, comprising a first level for transformation into T mode; and FIG. 36 show row and column signals for a display addressed by a mode having two sets in accordance with the present invention, comprising a first level for transformation into U mode.

Numerous variants can be envisaged in the context of the present invention.

DETAILED DESCRIPTION OF THE INVENTION

Variant 1 of the Invention

There follows initially a description of a first variant in accordance with the present invention, the description being given with reference to accompanying FIGS. 10, 11, and 12.

As can be seen in FIGS. 10 to 12, in the context of the present invention, the rising edge Fm of the signal that is to break anchoring (stage C) is in the form of a ramp. The duration of this ramp is written $\tau_R$.

Examples of control signals for application to the terminals of the pixel in the first variant of the invention are shown in FIG. 10 for transformation into the U texture and in FIG. 11 for transformation into the T texture.

Figure 3:
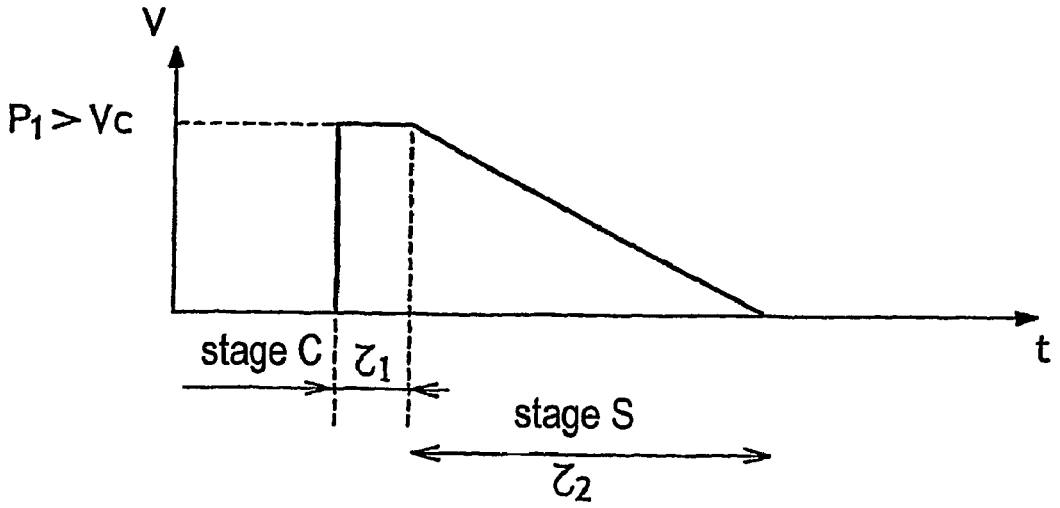
Figure 4:
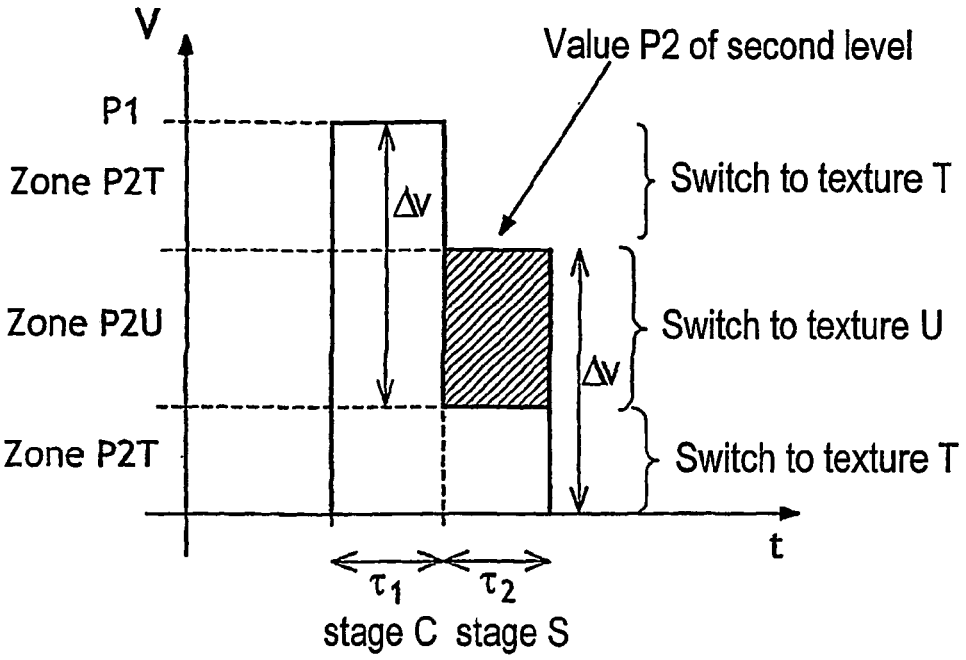
Figure 5:
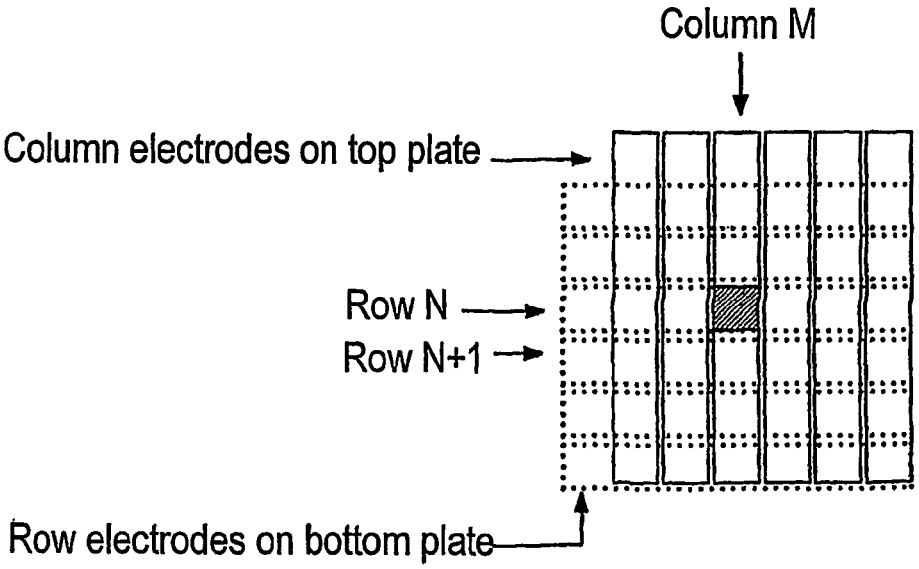
Figure 10A:
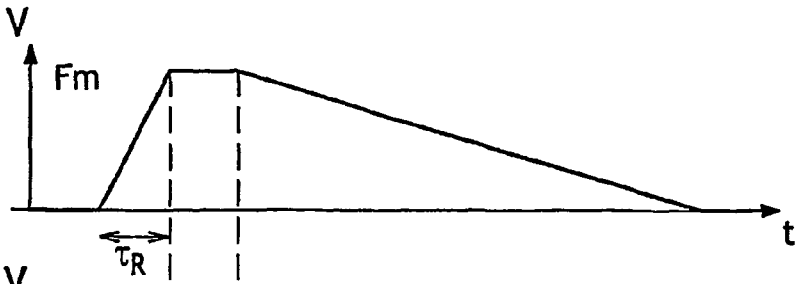
FIG. 10 is a diagram showing five types of pixel signals in accordance with the present invention adapted for transforming a pixel into the U state, in the context of a first variant of the invention.

FIG. 10*a* reproduces the signal of FIG. 3 for U transformation and includes variant 1 of the invention. In this example the descending edge of the signal is formed by a rectilinear ramp.

Figure 10B:
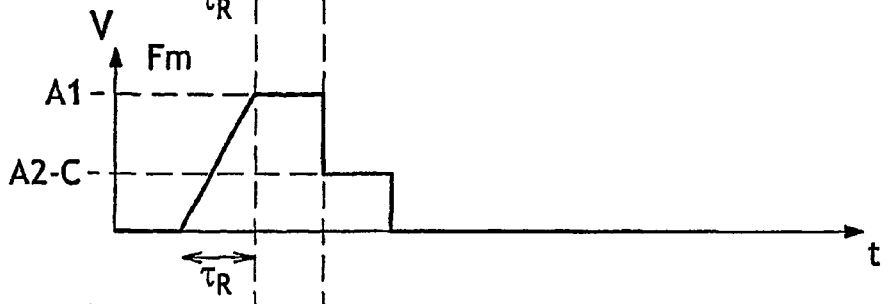

FIG. 10*b* reproduces the signal of FIG. 6*d* for U transformation and includes variant 1 of the invention. In this example the descending edge of the signal is formed by a stepped signal having a single intermediate level.

Figure 10C:
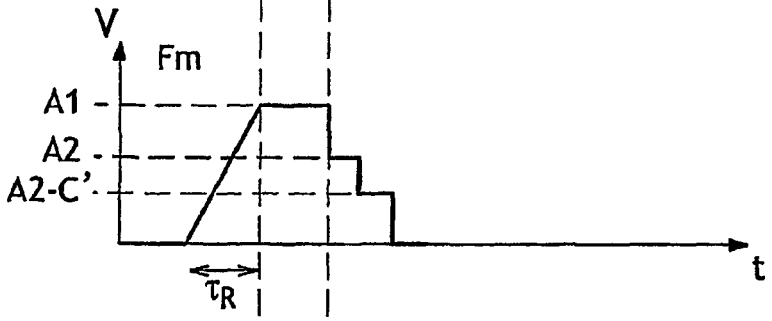

FIG. 10*c* reproduces the signal of FIG. 7*b* for U transformation and includes variant 1 of the invention. In this example the descending edge of the signal is formed by a stepped signal having two successive levels.

Figure 8A:
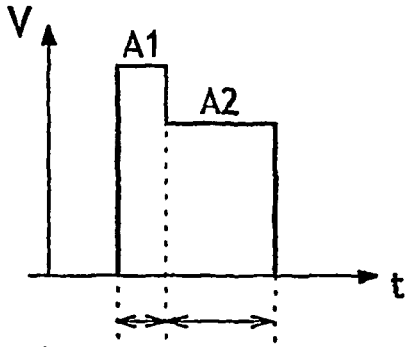
Figure 8B:
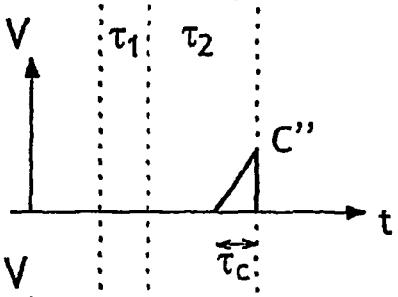
Figure 8C:
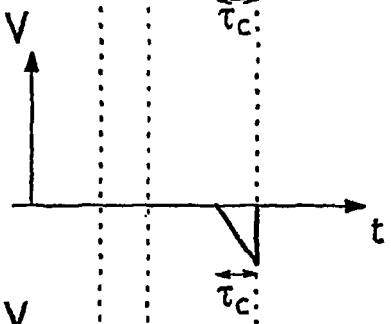
Figure 8D:
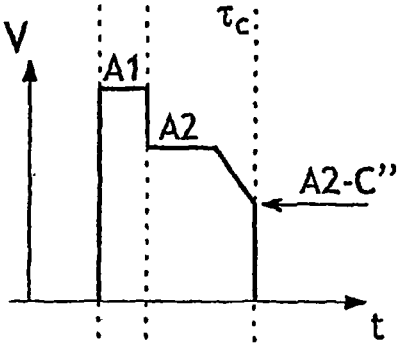
Figure 10D:
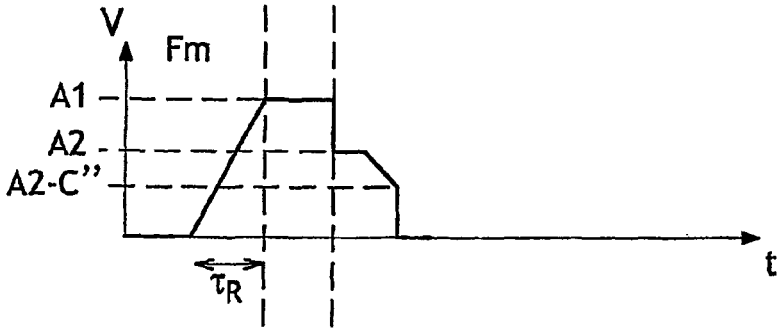

FIG. 10*d* reproduces the signal of FIG. 8*d* for U transformation and includes variant 1 of the invention. In this example, the descending edge of the signal is formed by a signal having an intermediate level followed by a descending ramp, in turn followed by an abrupt descending edge.

Figure 10E:
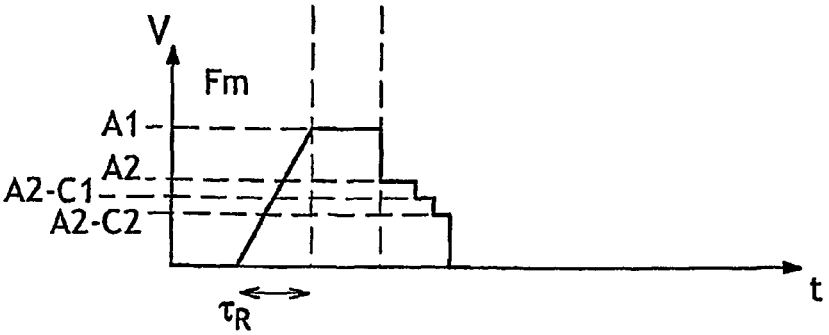

FIG. 10*e* reproduces the signal of FIG. 9*d* for U transformation and includes variant 1 of the invention. In this example, the descending edge of the signal is formed by a stepped signal having three successive levels.

For each of the signals shown in FIG. 10, the drop between two successive levels of the descending edge must not exceed the critical threshold value ΔV.

Figure 1:
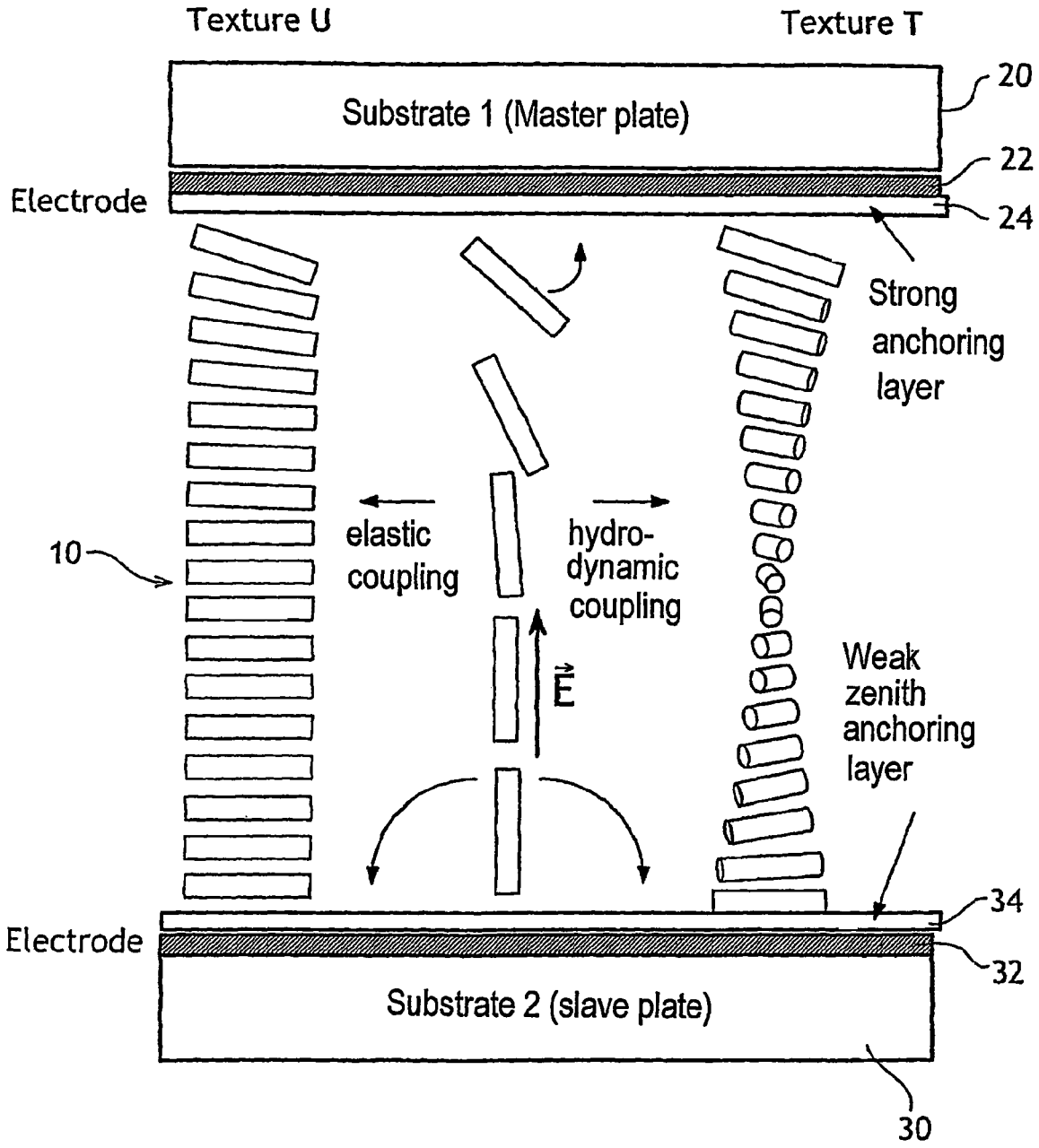
Figure 2:
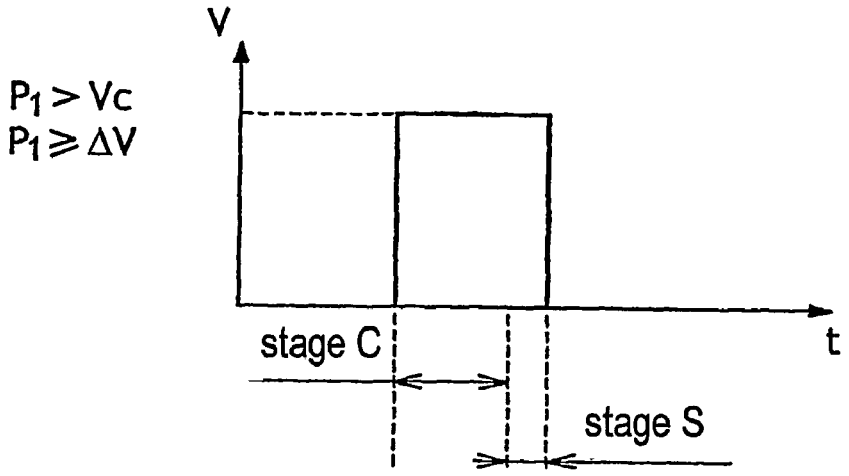
Figure 11A:
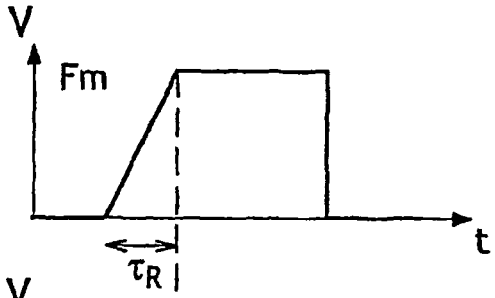
FIG. 11 is a diagram showing five types of pixel signal in accordance with the present invention and adapted for transforming the pixel into the T state in the context of a first variant of the invention.

FIG. 11*a* reproduces the signal of FIG. 2 for T transformation and includes variant 1 of the invention. In this example, the descending edge of the signal is formed by an abrupt edge.

Figure 11B:
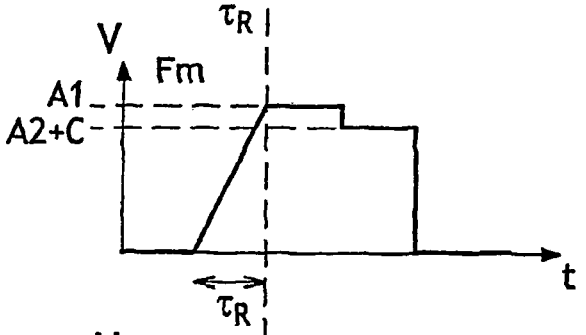

FIG. 11*b* reproduces the signal of FIG. 6*e* for T transformation and includes variant 1 of the invention. In this example, the descending edge of the signal is formed by a stepped signal comprising a single intermediate level.

Figure 11C:
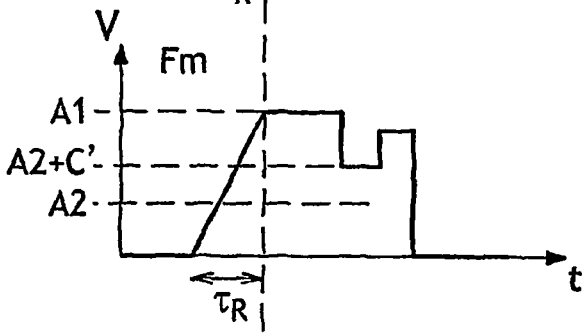

FIG. 11*c* reproduces the signal of FIG. 7*e* for T transformation and includes variant 1 of the invention. In this example, the descending edge of the signal is formed by a stepped signal-comprising two successive levels, the second of these levels being greater in amplitude than the first.

Figure 8E:
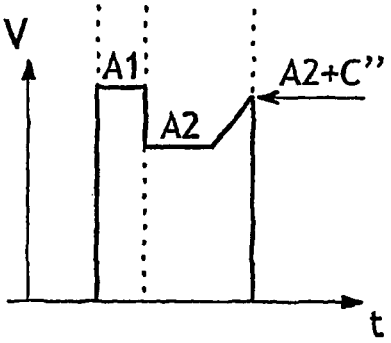
Figure 11D:
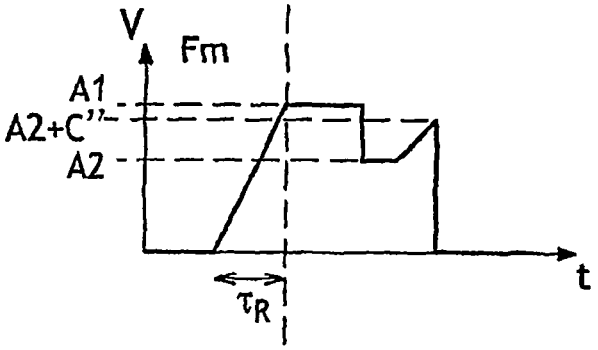

FIG. 11*d* reproduces the signal of FIG. 8*e* for T transformation and includes variant 1 of the invention. In this example, the descending edge of the signal is formed by a signal comprising an intermediate level followed by a rising ramp, itself followed by an abrupt descending edge.

Figure 11E:
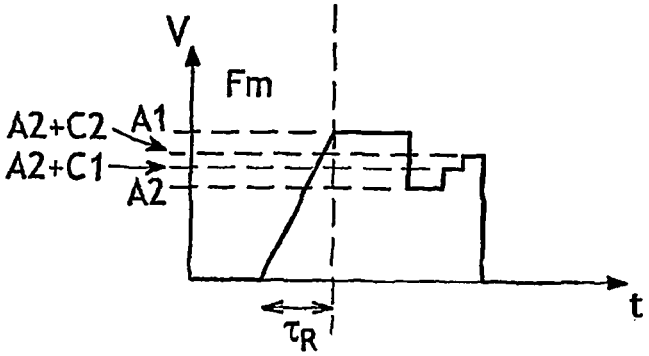

FIG. 11*e* reproduces the signal of FIG. 9*e* for T transformation and includes variant 1 of the invention. In this example, the descending edge of the signal is formed by a stepped signal comprising three successive levels, of amplitude that increases from each level to the following level.

For each of the signals shown in FIG. 11 the descending edge includes at least one sudden drop that is greater than the critical threshold value ΔV.

More generally, when the BiNem is multiplexed mode, variant 1 of the invention consists in replacing the conventional abrupt rising edge in the breaking signal by a sloping signal of duration $\tau_R$.

The corresponding row signal is shown diagrammatically in FIG. 12. It has a sloping rising edge and a stepped descending edge with a single intermediate level. The row signal could equally well have a single level only, i.e. A1=A2.

In a two-level mode where the first level is said to be "simultaneous" (see below) the row signal of FIG. 12 may be applied simultaneously to a plurality of rows at once instead of row by row as is the case for a standard multiplexed mode.

In multiplexed mode, the associated column signal is as shown in FIG. 7*b* (single positive squarewave pulse), 8*b* (positive signal with a sloping rising edge and an abrupt descending edge), or 9*b* (positive square pulse with two levels, the second being of amplitude, greater than the first) for U transformation and as shown in FIG. 7*c* (single negative squarewave pulse), 8*c* (negative signal with a sloping rising edge and an abrupt descending edge), or 9*c* (negative square pulse with two levels, the second level being of greater amplitude than the first) for T transformation.

Variant 2 of the Invention

There follows a description of a second variant implementation in accordance with the present invention, described with reference to accompanying FIGS. 13, 14, and 15.

Figure 13:
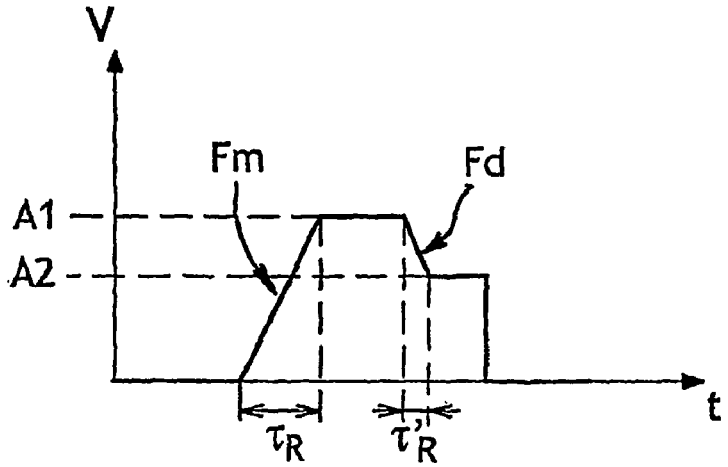
FIG. 13 is a diagram of a row signal in accordance with the present invention in the context of a second variant of the invention.

In FIGS. 13 to 15, there can be seen the same rising edge Fm in the signal that is for breaking anchoring (stage C) that presents a ramp waveform. The duration of the ramp is written $\tau_R$.

The second variant of the invention can be described starting from the multiplexed addressing mode of the BiNem. This second variant of the invention recommends replacing the conventional abrupt descending edge of the row signal between the levels A1 and A2 by a descending edge Fd in the form of a slope of duration $\tau_R'$.

The row signal in variant 2 of the invention, superposed on above-described variant 1 (sloping rising edge), is shown diagrammatically in FIG. 13. This signal comprises a sloping rising edge followed by a level for breaking anchoring, a sloping descending edge followed by a level, and a sudden drop for selection purposes.

In a two-level mode in which the first level is said to be simultaneous (see below), the row signal of FIG. 13 can be applied simultaneously to a plurality of rows at once instead of row by row as is the case in a standard multiplexed mode.

In multiplexed mode, the associated column signal is as shown in FIG. 7*b* (single positive squarewave pulse), 7*b* (positive signal with a sloping rising edge and an abrupt descending edge), or 9*b* (a positive two-level pulse, the second level being of amplitude greater than the first) for U transformation, and as shown in FIG. 7*c* (single negative squarewave pulse), 8*c* (negative signal with a sloping rising edge and an abrupt descending edge), or 9*c* (a two-level negative pulse, the second level being of amplitude greater than the first) for T transformation.

FIG. 14 shows pixel signals in variant 2 superposed on variant 1 for U transformation.

Figures 14A, 14B, 14C, 14D:
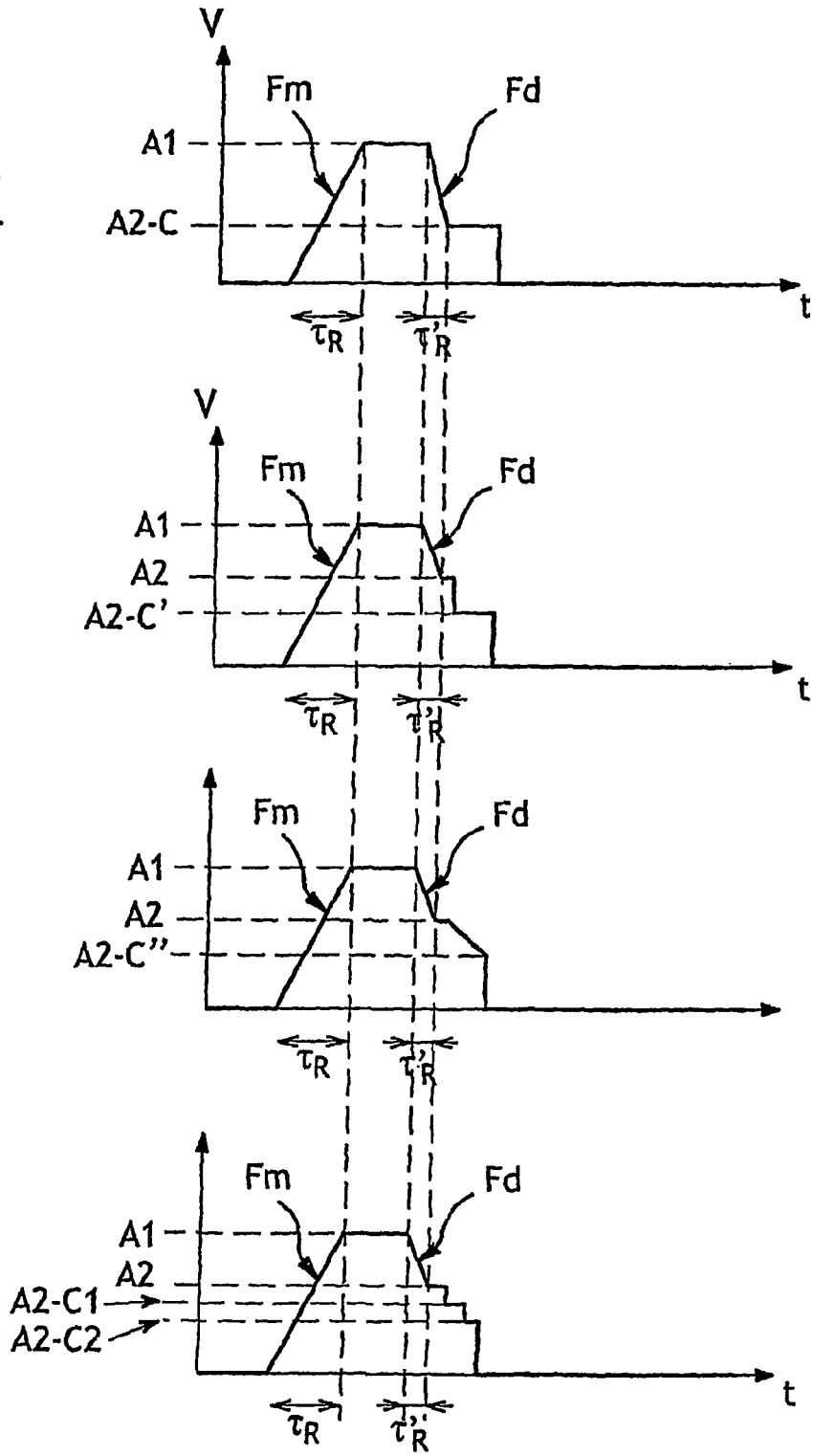
FIG. 14 is a diagram showing four types of pixel signal in accordance with the present invention and adapted to transformation into the U state in the context of a second variant of the invention.

FIG. 14*a* reproduces the signal of FIG. 10*b* and superposes variant 2.

FIG. 14*b* reproduces the signal of FIG. 10*c* and superposes variant 2.

FIG. 14*c* reproduces the signal of FIG. 10*d* and superposes variant 2.

FIG. 14*d* reproduces the signal of FIG. 10*e* and superposes variant 2.

In this case also, for each of the signals shown in FIG. 14, the drop between two successive levels in the descending edge must not exceed the critical threshold value ΔV.

FIG. 15 shows examples of pixel signals in variant 2 superposed on variant 1, for T transformation.

Figure 15A:
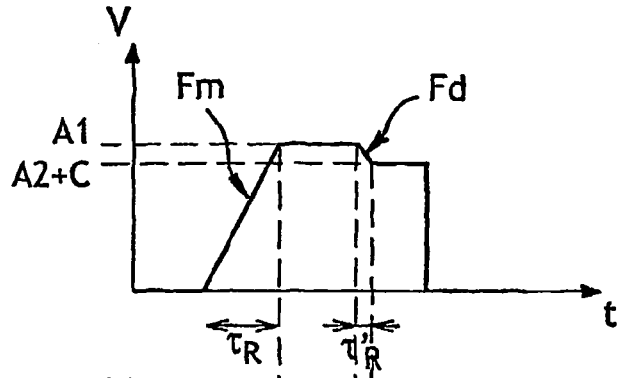
FIG. 15 is a diagram showing four types of pixel signal in accordance with the present invention adapted to transformation into the T state in the context of the second variant of the invention.

FIG. 15*a* reproduces the signal of FIG. 11*b* and superposes variant 2.

Figure 15B:
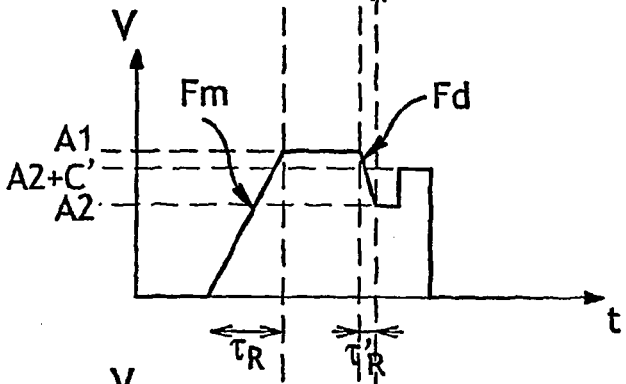

FIG. 15*b* reproduces the signal of FIG. 11*c* and superposes variant 2.

Figure 15C:
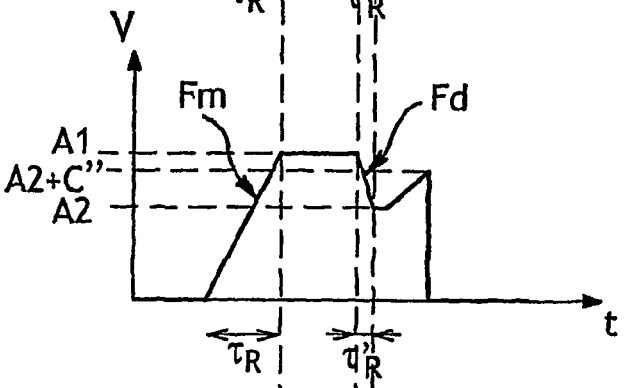

FIG. 15*c* reproduces the signal of FIG. 11*d* and superposes variant 2.

Figure 15D:
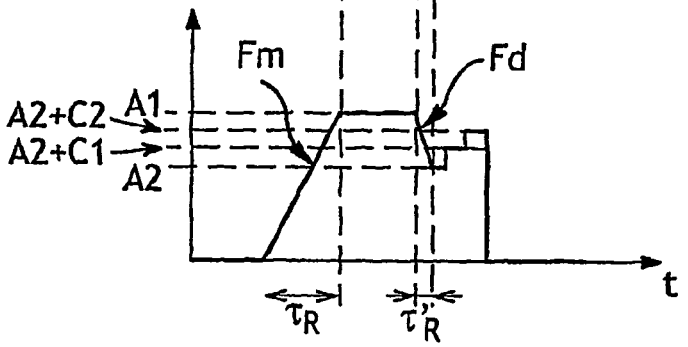

FIG. 15*d* reproduces the signal of FIG. 11*e* and superposes variant 2.

In this case also, for each of the signals shown in FIG. 15, the descending edge includes at least one sudden drop of amplitude greater than the critical threshold value ΔV.

Other Column Signals

In addition to the column signals shown in FIGS. 7*c*, 8*c*, and 9*c*, a column signal as shown in FIG. 16 can be used in multiplexed modes in both variants of the invention. This column signal comprises a pulse of duration $\tau_c$ having a sloping rising edge and a level which is terminated by an abrupt descending edge.

The pixel signals corresponding to this waveform for the column signal as applied to variant 1 of the invention in combination with a row signal as shown in FIG. 12 are shown in FIG. 17*a* for U transformation and 17*b* for T transformation.

The signal shown in FIG. 17*a* has a sloping rising edge, a level for breaking anchoring, an abrupt descending edge segment, a level segment, a sloping descending edge segment another level segment, and a final abrupt descending edge.

The drop between two successive levels in the descending edge of the signal shown in FIG. 17*a* must not exceed the critical threshold value ΔV.

The signal shown in FIG. 17*b* comprises a sloping rising edge, a level for breaking anchoring, an abrupt descending edge segment, a level segment, a sloping rising edge segment, and a final abrupt descending edge.

The descending edge in the signal shown in FIG. 17*b* includes at least one sudden drop (preferably the last descending edge) of amplitude greater than the critical threshold value ΔV.

Range of Interest for the Numerical Value of the Slope Fm.

It is recalled that in conventional addressing of a BiNem, pulses are usually used having a duration of the order of 1 millisecond to several milliseconds. The amplitude of the voltage P1 for application to the pixel in which anchoring is to be broken is of the order of 10 V to 30 V for a cell having a thickness of 1.5 micrometers (μm) to 2 μm.

In the context of the present invention, the range of slopes for the rising edge Fm providing the advantages described below without excessively lengthening the duration of the addressing pulse is 0.5 V/μs to 0.0001 V/μs, and preferably 0.1 V/μs to 0.005 V/μs, i.e. for a voltage P1 of 20 V, a duration $\tau_R$ of 40 μs to 200 ms, preferably 200 μs to 4 ms. This duration $\tau_R$ is preferably greater than 300 μs. For the descending edge slope Fd (variant 2), the order of magnitude is the same.

Multiplexing Options: Obtaining a Mean Value of Zero

In order to take account of the risks of certain liquid crystal materials becoming degraded by electrolysis on being subjected to a DC voltage, it is advantageous to apply signals to the pixels that have a mean value of zero.

A first option is to use signals of opposite polarities following one another (described in document [3]). An example of the row signal of variant 1 of the invention using this option 1 is shown in FIG. 18 naturally, the column signal which is selected to be complementary and to have one of the above-described waveforms, must likewise have alternating polarity inversions like the row signal.

A second option (also described in document [3]) is to invert the sign of the signals (row and column) for each image. FIG. 19 shows the row signal in accordance with variant 1 corresponding to this second option for achieving a symmetrical result.

The circuit delivering the row signal in the above examples and because of the need to deliver a symmetrical signal needs to deliver a voltage of ±A1 giving a total excursion of 2.A1. A considerable simplification of the row circuit can be achieved if the maximum excursion thereof is reduced to a value of less than 2.A1. To do this, it suffices to change the operating midpoint $V_M$ of the row signal and of the corresponding column signal synchronously during the second polarity. Thus, if the starting point is as shown in FIG. 18, the idea is to add a common voltage $V_M$ to all of the row signals and column signals during the stage of making them symmetrical, where the value of $V_M$ changes between two symmetrical stages. This third option is also described in document [3] and applies in the same manner as the preceding options to the signals of variant 1 of the invention.

Figure 20A:
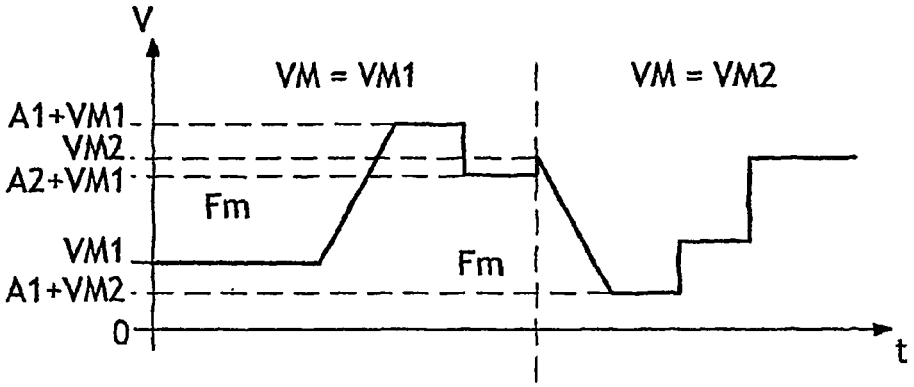
Figure 20B:
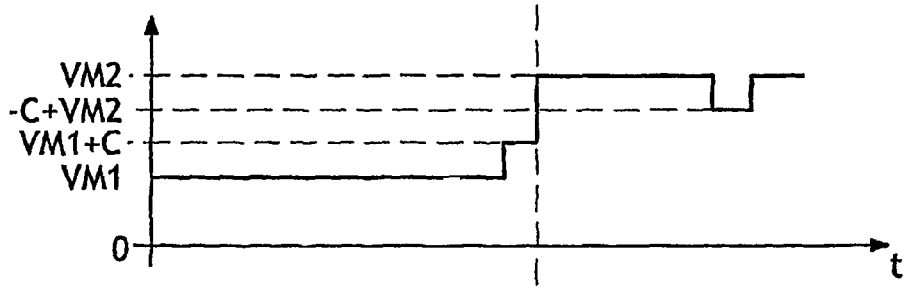
Figure 20C:
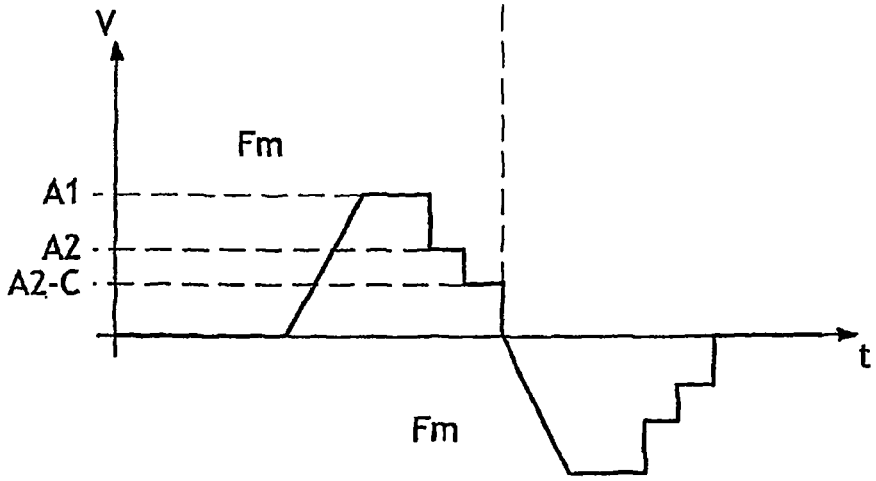

FIG. 20 shows the reduction in the voltage excursion of the row circuit obtained using the voltage $V_M$, as applied to variant 1 of the invention, with, by way of example, a square-wave type column signal (FIG. 7*b*) for a U transformation (FIG. 20*a* shows the row signal; FIG. 20*b* shows the column signal; and FIG. 20*c* shows the resulting pixel signal). The pixel signal shown in FIG. 20*c* remains unchanged compared with the above-described signal shown in FIG. 10*c*, i.e. the signal as obtained with $V_M$.

The signal $V_M$ is equal to $V_{M1}$ during the first stage of symmetrification, and it is equal to $V_{M2}$ during the second stage of symmetrification.

In a variant, a time interval may be added between the two stages of symmetrification.

Naturally, variant 2 of the invention, applied in combination with variant 1, is compatible with the various symmetrification operations for the purpose of obtaining a zero mean value.

Multiplexing Option: Addressing with Time Overlap Between Row Addressing Pulses

Document [4] describes an addressing mode for a BiNem screen with time overlap between row pulses. The signal involved (e.g. a two-level signal) still comprises an anchoring-breaking stage and a selection stage, and its total duration is $\tau_L$. The following row signal L2 is no longer offset by a duration $\tau_L$ from the origin of the preceding row signal L1, as is conventional, but by a shorter duration $\tau_D$, such that:

$\tau_c \leqq \tau_D < \tau_L$ with $\tau_c$ being the duration of the column signal.

This method of addressing which is intended mainly for increasing the speed at which an image can be displayed is specific to a BiNem, with switching that depends only on the waveform of the descending edge of the pixel signal.

Addressing with time overlap as described in document [4] is compatible with the signals described in variants 1 and 2 of the invention. FIG. 21 shows an example of this mode of addressing as applied to variant 1 of the invention, e.g. with squarewave-shaped column signals and with three consecutive rows being addressed at a time. The first four rows of FIG. 21 show the row signals applied to four successive rows of the screen, and the fifth row in FIG. 21 shows the corresponding column signal.

Naturally, any of the column signal waveforms described above could be used.

This mode of addressing can also be combined with a symmetrification method so as to obtain a zero mean value.

In this mode of addressing, the duration of the addressing pixel pulse is generally longer than the "conventional" duration which lies in the range 1 ms to a few ms. A shallower slope can thus be accepted in this example. A typical value for the slope in the example of a long addressing pulse is 0.001 V/μs, giving a duration $\tau_R$ of 20 ms.

ADVANTAGES OF THE INVENTION

A major advantage of the invention lies in limiting the current Iins that is drawn while addressing a pixel during the rise in the anchoring-breaking signal, as is explained below.

The amplitude of the breaking voltage to be reached across the pixel terminals is written $V_0$ (referred to as P1 in FIGS. 2 and 3 and A1 for a multiplexed signal as shown in FIGS. 6 to 9).

By way of example, a single pixel display is considered having capacitance Cp and series resistance (due to the ITO electrodes) Rp. This pixel is assumed to be controlled by a driver circuit having complementary metal oxide-on-silicon (CMOS) switches and a constant voltage source of voltage $V_0$, as shown in FIG. 22.

The frequency of the control signal is written f. For a bistable liquid crystal display (LCD) this frequency is theoretically equal to the frequency with which it is desired to refresh the data displayed on the screen. However, in the calculation below which relates to the time required for addressing a screen, and more particularly the duration of a row pulse, long times must not be taken into consideration because of problems of liquid crystal electrolysis. For calculation purposes, a frequency of 10 hertz (Hz) is selected.

With the type of circuit shown in FIG. 22, and in obvious manner, the mean power consumption per pixel $P_{mean}$ and the mean current $I_{mean}$ delivered by the voltage source $V_0$ are given as follows:

$$P_{mean}=fC_pV_0^2$$

$$I_{mean}=fC_pV_0$$

There follows a calculation to give the maximum instantaneous current delivered by the voltage source $V_0$ for a rectangular signal and for a sloping signal applied to the terminals of the pixel.

Maximum Instantaneous Current for a Conventional Rectangular Signal

The instantaneous charging current for a pixel in response to a conventional rectangular control pulse is determined. The equivalent circuit given in FIG. 23 is for a rectangular applied signal V(t) with zero rise time and amplitude $V_0$.

The current flowing through the pixel at instant t after application of the pulse is a decreasing exponential:

$$I(t) = \frac{V_0}{R_p}\exp\left(-\frac{t}{R_pC_p}\right)$$

The maximum current occurs at t=0 and is equal to $V_0/R_p$. The charging pulse is short, having a duration approximately equal to $3R_pC_p$. These signals are shown in FIG. 24.

This calculation is correct providing the duration of the slope of the applied rectangular signal is much shorter than the time constant of the pixel, i.e. $R_pC_p$.

Maximum Instantaneous Current when the Signal has a Shallow Slope in Accordance with the Present Invention In this example, the applied signal is a pulse having a shallow slope, with a rise time equal to $\tau_R$ at a maximum amplitude $V_0$ The current flowing through the pixel at instant t from the start of the pulse ($t<\tau_R$) is of the following form (cf. FIG. 25):

$$I(t) = \frac{V_0C_p}{\tau_R}\left[1-\exp\left(-\frac{t}{R_pC_p}\right)\right]$$

The instantaneous current is at a maximum at $t=\tau_R$ and is approximately equal to $V_0C_p/\tau_R$.

The duration of this current peak is approximately equal to $\tau_R$.

This calculation remains correct providing the duration of the slope $\tau_R$ is about three times greater than the time constant $R_pC_p$ of the pixel.

Comparisons Between the Two Examples

The following apply:

$$I_{mean} = fC_pV_0 \quad \text{(Equation 1)}$$

$$I_{ins}(\text{square}) = V_0/R_p$$

$$I_{ins}(\text{slope}) = \frac{V_0}{\tau_R}C_p$$

Giving:

$$\frac{I_{ins}(\text{square})}{I_{mean}} = \frac{1}{R_pC_pf}$$

$$\frac{I_{ins}(\text{slope})}{I_{mean}} = \frac{1}{\tau_Rf}$$

$$\frac{I_{ins}(\text{square})}{I_{ins}(\text{slope})_i} = \frac{\tau_R}{R_pC_p}$$

There follow various numerical applications with examples of bistable pixels of the BiNem type:

$R_p=1000\Omega$ with:

$C_p$/unit area 15 nanofarads per square centimeter (nF/cm$^2$);

f=10 Hz;

$\tau_R$=400 μs.

Example 1 single directly-addressed pixel of area=1 cm$^2$ giving capacitance $C_p$=15 nF, i.e. $R_pC_p$=15 μs. Thus:

$$\tau_R \gg R_pC_p:\ 400\ \mu s \gg 15\ \mu s$$

$$\frac{I_{ins}(\text{square})}{I_{mean}} = 6000$$

$$\frac{I_{ins}(\text{slope})}{I_{mean}} = 250$$

$$\frac{I_{ins}(\text{square})}{I_{ins}(\text{slope})} = 24$$

Example 2 row in a BiNem display in multiplexed mode.

Row dimension: 2 mm×20 mm, i.e. an area of 40 mm$^2$=0.4 cm$^2$.

$C_p$=6 nF $R_pC_p$=6 μs

Giving:

$$\tau_R \gg R_pC_p:\ 400\ \mu s \gg 6\ \mu s$$

$$\frac{I_{ins}(\text{square})}{I_{mean}} = 15{,}000$$

$$\frac{I_{ins}(\text{slope})}{I_{mean}} = 250$$

$$\frac{I_{ins}(\text{square})}{I_{ins}(\text{slope})} = 60$$

It can thus be seen that changing from a conventional rectangular signal to a signal in accordance with the present invention presenting a slope of 400 μs duration reduces the instantaneous maximum current by a factor of more than 20. More generally, the improvement is proportional to the duration of the slope $\tau_R$.

Another advantage of decreasing consumption is a reduction in the size needed for the transistors, and thus in the area of silicon that is needed to perform row and column voltage switching, which means that the cost of the addressing electronics can be reduced.

First Embodiment of the Invention

There follows a description of a system using variant 1 of the invention. The example described comprises a display module using a BiNem type display for a contactless smart card having no battery or any other energy storage component, of the kind shown in FIG. 26. In this device, energy is supplied (intermittently) by an induction loop 50 and a power supply circuit 52. This circuit is connected to a microcontroller 54, a driver, circuit 56, and a BiNem display 58.

When the loop 50 is placed close to an emitter device, it powers the power supply circuit 52 which delivers a stabilized DC voltage to the microcontroller 54 and to the driver circuit 56. So long as the loop 50 is powered, the controller 54 can update the bistable display via the driver circuit 56. The power consumed for these operations must remain small since the amount of energy transferred via the loop 50 is limited to a power supply of the order of a few milliwatts (mW).

The rest of the time the system is not powered. The information that can be read from the BiNem display 58 is thus the information that results from the most recent update.

Under all circumstances, a power supply circuit can deliver a maximum instantaneous current $I_{Max}$, and above that value it can no longer maintain the nominal voltage for which it is designed. If the current consumed by the driver circuit 56 exceeds the acceptable maximum value, even briefly, then a voltage drop occurs (cf. FIG. 27), and it is no longer guaranteed that the logic circuits or the microcontroller 54 will operate properly. A general system failure can then occur.

A conventional BiNem display operates with signals that are initially rectangular: the maximum instantaneous power that it consumes can be high.

The instantaneous maximum power calculation described above gives:

$$I_{ins}(\text{square})=V_0/R_p$$

Thus with $V_0$=20 V and $R_p$=1000Ω (the above numerical example), $$I_{ins}=20\text{ mA}$$

Whereas the mean current $I_{mean}$ is:

$$I_{mean}=fC_pV_0=0.003\text{ mA for }C_p=15\text{ nF}$$

The maximum instantaneous current $I_{ins}$ that the source must be capable of delivering is much greater than $I_{mean}$ since the pixel: charges and discharges mainly during switching of the control signal. With conventional rectangular control signals, current is zero or nearly zero nearly all the time, but presents marked peaks each time voltage switches.

During current consumption peaks, it is clear that the power needed can exceed the available instantaneous power from the energy source.

Numerically-Worked Example

Typically, the power available with an induction loop 50 as described above is of the order of 20 mW.

The maximum instantaneous power for a squarewave type signal is:

$$P_{(ins\ max,\ square)}=R_p\cdot I_{ins}(\text{square})^2=400\text{ mW}$$

It is clear that a standard induction loop cannot deliver such a level of instantaneous power.

In general, this difficulty is solved by adding an energy storage component (capacitor, inductor, or storage battery) to the power supply circuit 52. This component stores the energy which the circuit will require during its peaks of consumption.

However, in a smart card application, which needs to comply with a very small maximum thickness, compactness constraints are so severe that it is not possible to add energy-storage components. Nor is it possible to integrate the required capacitance in monolithic integrated circuits on silicon (it would be necessary to devote tens of square millimeters ($mm^2$) of silicon, which is absurd, economically speaking).

The present invention seeks to provide a solution to this problem by enabling the instantaneous power requirement of the display to be reduced.

Numerically-Worked Example

It is assumed that $\tau_R$=2.5 ms.

The maximum instantaneous power for a signal in accordance with the present invention possessing such a slope is given by:

$$P_{(ins\,max,slope)}=V_0\cdot I_{ins}(\text{slope})=\frac{V_0^2}{\tau_R}C_p=2.4\text{ mW}$$

This power can be delivered by the induction loop 50.

Generating the Signals Described in the Invention

In order to simplify the description, the example described relates to a driver circuit 56 connected to a BiNem display matrix 58 comprising two rows L1 and L2 multiplied by two columns C1 and C2 (giving four pixels that are addressable in multiplexed mode). This is shown in FIG. 28.

It is assumed that a positive single-pole multiplexing scheme is used for the rows L1 and L2 and a bipolar scheme is used for the columns C1 and C2, with $V_M$ being constant (as shown in FIG. 29). This multiplexing scheme together with the signals shown in FIG. 29 corresponds to an arbitrary choice for fixing ideas, and other variants described above could be used without changing the nature of the implementations proposed. It should be observed that as shown diagrammatically in FIG. 29, the signals shown correspond to a U state at the intersection of row L1 and column C1 and a T state at the other intersections of the rows and the columns of the display.

The control circuit 56 can then be constituted by ten analog switches C01 to Co10 as shown in FIG. 30 (more generally the number of switches is twice the number of rows plus three times the number of columns):

- each row signal is obtained by switching one of two voltages VL(t) or 0V by using switches Co1 to, Co4; and
- each column control signal is obtained by switching one of three voltages +C(t), −C(t), or 0V via switches Co5 to Co10.

In this example, it is necessary to provide the time-varying analog signals VL(t), +C(t), and −C(t) as shown in FIG. 31. These analog signals are naturally synchronized with the multiplexing stages.

It is known that analog switches Co can be made using transistors. Driver circuits 56 for liquid crystal displays conventionally use MOS technology or variants of such technology for transistors, which transistors are characterized by the maximum voltages that they can switch.

Nevertheless, it should be observed that in this context, the driver circuit 56 must include a device enabling ramp signals VL(t) and C(t) to be generated for use by the switching stages.

This difficulty can be avoided so as to reduce the complexity and thus the surface area of silicon or the cost of manufacturing the driver circuit by using a second implementation.

In this second implementation, the driver circuit 56 includes a circuit that generates constant voltages only for feeding the switching stages Co.

This implementation takes advantage of the characteristics of the transistor for generating ramps. Transistors are normally used by "digital" electronic circuit designers as on/off switches. The control electrode jumps from a voltage at which the transistor constitutes an insulator to a voltage for which the transistor conducts like a resistor. Nevertheless, between those two voltages, there exist intermediate values for the control voltage where the transistor passes a constant current i over a broad range of voltages applied to its terminal. If the transistor is connected to a generator in series with a capacitor of capacitance C, then the voltage across the terminals of the capacitor is a ramp having the following-slope:

$$\frac{dV}{dt} = \frac{C}{i}$$

which ramp terminates when the capacitor has been charged to the voltage of the generator.

A row circuit based on this principle is shown in FIG. 32. It comprises only two MOS transistors 60 and 62. The main conduction paths of these two transistors 60, 62 are connected in series between ground and a power supply terminal 64 capable of receiving either voltage V1 or voltage V2. The control electrodes of these two transistors are connected in common. The output from this circuit which is connected to the row electrodes is taken from the drain/source common point of the transistors 60 and 62. The transistor 60 is connected to the power supply terminal. The transistor 62 is connected to ground.

FIG. 33 shows the signals associated with this circuit. More precisely, FIG. 33*a* shows the control signal applied to the control electrodes of the transistors 60 and 62, FIG. 33*b* shows the resulting row signal taken from the common drain/source terminal of the transistors 60 and 62, FIG. 33*c* shows a column signal applied to the display to obtain a uniform state, and FIG. 33*d* shows the column signal applied to the display to obtain a twisted state.

Essentially, the control signal shown in FIG. 33*a* comprises a first state E1 during which both transistors 60 and 62 are off (row voltage is zero), a second state E2 during which the transistor 60 is conductive (row voltage increases progressively so as to reach voltage V1), a third state E3 during which both transistors 60 and 62 are off (row voltage remains at the value V1), a fourth state E4 during which the transistor 62 is conductive (row voltage decreases progressively down to voltage V2), a fifth state E5 during which transistor 60' is conductive (row voltage is maintained at V2), a sixth state E6 during which transistor 62 is conductive (row voltage drops to zero), and a seventh state E7 during which both transistors 60 and 62 are off (row voltage remains at zero).

During the rising ramp (state E2) and the level V1 (state E3), the power supply delivers the voltage V1. During the first descending ramp (state E4) it is necessary for the power supply to switch from V1 to V2. It remains at V2 during the level which corresponds to state E5. The power supply is then returned to zero.

A variant without a second level (state E5) enables operation to be simplified by using a constant power supply voltage V1.

The slope of the ramps is adjustable by adjusting the voltages of the control electrodes of the transistors 60 and 62.

This circuit enables the polarity of the signals to be changed from one image to another so as to obtain a mean voltage value that is zero across the terminals of the pixels. Only the control signals and the power supply voltages need to be adapted. The power supply voltages are 0, V1, and V2 for positive signals and 0, V1-V2, and V1 for negative signals.

Both transistors 60 and 62 need to be dimensioned so as to be capable of accepting the strong current during the descent at the end of the row signal and the power that is dissipated during the ramps. For the positive signal the strong current passes through the transistor 62, and for the following image when the signal is negative, it passes through the transistor 60. Nevertheless, it should be observed that these strong currents do not draw on the power supply of the device. These currents are due to the capacitors constituted by the pixels discharging.

A column circuit based on this principle is shown in FIG. 34. It has three MOS transistors 70, 72, and 78.

In comparable manner to transistors 60 and 62, the main conduction paths of the two transistors 70 and 72 are connected in series between a power supply terminal 74 suitable for receiving either a voltage +C or a voltage $V_0$+C, and a power supply terminal 76 suitable for receiving either a voltage −C or a voltage $V_0$−C. The control electrodes of the transistors 70 and 72 are connected in common. The output from the circuit which is connected to the column electrodes is taken from the interconnected sources of the two complementary transistors 70 and 72. The transistor 70 is adjacent to the power supply terminal 74. The transistor 72 is adjacent to the power supply terminal 76.

The main conduction path of the transistor 78 is connected between the output from the circuit (point in common constituting the sources of transistors 70 and 72) and a power supply terminal capable of receiving one or other of the voltages 0 and $V_0$.

The transistors 70 and 72 deliver the constant currents of the column ramps when they are controlled to be in the conductive state. They may be small in size. The transistor 78 must be capable of passing the end-of-signal current. It operates as an on/off switch. For the image displayed by means of a positive signal, this circuit is powered by the voltages +C, 0, and −C. For the image displayed by a negative signal, the voltages are $V_0$+C, $V_0$, and $V_0$−C.

Second Embodiment of the Invention

The parameters of the liquid crystal cell, the voltages and addressing mode, and the operating temperature all constitute factors that can influence the switching of a BiNem cell. It should be observed that depending on the values of these factors, one of the textures can be "easy" to obtain while the other texture becomes "difficult" to obtain. For example, this applies particularly with the temperature factor, which is well known to influence the properties of liquid crystals and thus the characteristics of the hydrodynamic flow constituting the origin of switching to the T texture.

Furthermore, switching a BiNem cell causes the liquid crystal to move in the alignment direction of the molecules. This switching takes place more easily when the area that is to be switched is large. Thus, switching a plurality of rows simultaneously (a "packet" of rows), or indeed the entire display ("collective" switching) is easier than switching row by row.

These two observations in combination make it advisable to address a BiNem display in two steps:

- a "simultaneous" first step in which the pixels of the display are switched in packets or collectively to take up the "difficult" texture (using a sloping rising edge); and
- a second step in which the entire display is addressed in a conventional multiplexed mode so as to switch those pixels of the display that are to take on the "difficult" state (with a rising edge that may or may not be sloping).

When using this two-step-mode of addressing, simultaneous switching of some number of rows during the first step will cause the electronics to draw a large amount of current.

One solution then consists in using a signal of rising edge in accordance with the invention as the signal $V_{simul}$ which is applied simultaneously to a plurality of rows. In application of formula 1, using a sloping signal simultaneously over the entire display enables the peak current drawn to be reduced by a factor F(col)=$\tau_R$/RC(display). Using a simultaneous signal on a packet of rows, where each packet of rows represents a fraction r of the surface area, where the fraction r=the area of the packet of rows divided by the total area of all of the rows, enables the peak current drawn to be reduced by a further factor of r. Thus, F(packet)=F(col)/r.

The gradient of the slope may differ depending on the values of various factors such as the operating temperature of the display, for example.

An implementation of addressing in two steps in accordance with the invention is shown in FIG. 35, taking by way of example a collective signal of the type for T transformation. Two rows n and n+1 are involved in this non-limiting example, and the principle can be generalized to the entire display. The parameters ($V_{sT}$, $\tau_R/\tau'_P$) of the row signal $V_{simul}$ applied simultaneously to a plurality of rows are adapted to the collective switching-mode and can vary as a function of certain parameters. In this case, $V_{simul}$ has only one level, but it could equally well have two or more. The parameters (V'1, V'2, $\tau'_1$, $\tau'_2$, V'c, $\tau'_c$) of the multiplexing signals are also adapted and may take on values that are different from those used in the simple multiplexed mode.

An implementation of two-step addressing in accordance with the invention is shown in FIG. 36 using by way of example a collective signal of the U transformation type. Two rows n and n+1 are involved in this non-limiting example, and the principle can be generalized to the entire display. The parameters ($V_{sU1}$, $V_{sU2}$, $\tau_R$, $\tau''_p$) of the row signal $V_{simul}$ applied simultaneously to a plurality of rows are adapted to the collective switching mode and can vary as a function of various parameters. The multiplexing signal parameters (V"1, V"2, $\tau''_1$, $\tau''_2$, $V''_c$, $\tau''_c$) are likewise adapted and can take on values that are different from those used in the simple multiplexed mode.

Simultaneous switching for the difficult texture can be performed in "packets" of p rows, which are subsequently addressed in multiplexed mode, and then the following packet of p rows is addressed collectively and then in multiplexed mode, and so on until all of the rows of the display have been addressed.

Simultaneous switching for the difficult texture can also be performed collectively for all of the rows of the display, and then the display can be addressed in multiplexed mode for all of its rows, in the conventional manner.

Addressing as shown in FIG. 35 has been implemented on a BiNem display of 480 rows×640 columns. Table I below gives the values for the parameters used for $V_{simul}$ applied collectively to all of the display. These values vary with the temperature at which the display is used.

TABLE I

Example parameters for $V_{simul}$ applied "collectively" for a 480 × 640 BiNem display

| Parameters $V_{simul}$ (collective) | T = 0° C. | T = 25° C. | T = 40° C. |
|---|---|---|---|
| $V_{sT}$ (volt) | 30 | 25 | 15 |
| $\tau_R$ (μs) | 50,000 | 20,000 | 500 |
| $\tau'_p$ (μs) | 10,000 | 10,000 | 10,000 |
| $V_{sT}/\tau_R$ (volt/μs) | 0.0006 | 0.00125 | 0.03 |

It can be seen that for T=0°, the duration of the simultaneous step is 60 ms which leads to an optical disturbance over the entire display which is visible to an observer and is visually unpleasant.

Addressing the same display in packets of 48 rows, for example (instead of all 480 as above) enables the duration of the simultaneous step for one packet to be reduced, leading to a corresponding reduction in the induced optical disturbance while still retaining the same current. The capacitance of the switched area is divided by 10 so the rise time $\tau_R$ can be divided by the same factor of 10 while conserving the same instantaneous current. Table II gives an example of simultaneous switching by packets of 48 rows while conserving the same instantaneous current as in the example of Table I.

TABLE II

An example of parameters for $V_{simul}$ applied "in packets" of 48 rows, for a 480 × 640 BiNem display

| Parameters $V_{simul}$ (by packets of 48 rows) | T = 0° C. | T = 25° C. | T = 40° C. |
|---|---|---|---|
| $V_{sT}$ (volt) | 30 | 25 | 15 |
| $\tau_R$ (μs) | 5,000 | 2,000 | 50 |
| $\tau'_p$ (μs) | 10,000 | 10,000 | 10,000 |
| $V_{sT}/\tau_R$ (volt/μs) | 0.006 | 0.0125 | 0.3 |

The signal $V_{simul}$ can be a positive monopolar signal, a negative monopolar signal, or a bipolar signal that is not necessarily symmetrical. The important point is not its exact waveform but its function, which is to cause the rows of a display to switch either collectively or in packets so as to put them in a well-defined state (liquid crystal texture) prior to applying multiplexing signals, while simultaneously ensuring that the electronics of the display remain with an instantaneous current that is acceptable by virtue of using a slope in accordance with the invention.

In a conventional passive display device, the voltage ramp is easily generated by using conventional methods such as a digital-to-analog converter followed by amplifier stages. The signal is then applied to screen rows via row driver stages.

With a digital driver circuit, the digital-to-analog converter is integrated therein.

Naturally, the present invention is not restricted to the particular embodiments described above. It extends to any variant within its spirit.

In particular, the present invention can be applied equally well to making passive displays as to making active displays in which each pixel is controlled by a respective component, e.g. a transistor, that is itself capable of being switched between a conductive state and a non-conductive state.

Doc [1]: U.S. Pat. No. 6,327,017.
Doc [2]: C. Joubert, proceedings SID 2002, pp. 30-33.
Doc [3]: French patent No. 0 201 448.
Doc [4]: French patent 0 204 940.

The invention claimed is:

1. A display device comprising a bistable nematic liquid crystal matrix screen (58) with breaking of anchoring, including addressing means (56) suitable for generating and applying control signals to each pixel of the matrix screen, the device being characterized in that the control signals have sloping rising edges (Fm) presenting a gradient lying in the range 0.1 V/μs to 0.005 V/μs and that the rising edge (Fm) presents a duration $\tau_R$ greater than 300 μs, wherein the addressing means (56) are adapted to generate signals comprising two stages: a first stage for breaking anchoring, and a second stage for selection purposes, and in order to obtain a uniform texture, the addressing means (56) are adapted to generate signals for which the drop between two successive levels in the descending edge of the selection stage does not exceed a critical threshold value ΔV, while for obtaining a twisted texture, the descending edge includes at least one sudden drop greater than the critical threshold value ΔV.

2. A device according to claim 1, characterized by the fact that it uses two textures, one of which is uniform or lightly twisted in which the molecules are at least substantially parallel to one another, and the other of which differs from the first by a twist of the order of plus or minus 180°.

3. A device according to claim 1, characterized by the fact that the rising edge (Fm) presents a duration $\tau_R$ of 300 μs to 20 ms.

4. A device according to claim 1, characterized by the fact that the addressing and control signals also have sloping descending edges (Fd) at the end of a stage of breaking anchoring.

5. A device according to claim 4, characterized by the fact that the gradient of the descending edge (Fd) is of the same order of magnitude as the gradient of the rising edge (Fm).

6. A device according to claim 1, characterized by the fact that each pixel is controlled by a respective component, e.g. a transistor, capable of being switched between a conductive state and a non-conductive state.

7. A device according to claim 1, characterized by the fact that said control signals correspond to the difference of voltage between row pulses and column signals, said row pulses comprising a plurality of level and the duration of a column signal is shorter than the duration of the last level of a row pulse.

8. A device according to claim 7, characterized by the fact that the column signal is in the form of a squarewave.

9. A device according to claim 7, characterized by the fact that the column signal is in the form of a ramp.

10. A device according to claim 7, characterized by the fact that the column signal has two successive levels.

11. A device according to claim 1, characterized by the fact that the addressing means are adapted to generate signals on each of the pixels that have a mean value of zero.

12. A device according to claim 1, characterized by the fact that the addressing means are adapted to generate signals on each of the pixels that are successively of opposite polarities.

13. A device according to claim 1, characterized by the fact that the addressing means are adapted to generate successive row and column signals of opposite polarities.

14. A device according to claim 1, characterized by the fact that the addressing means are adapted to generate signals on each of the pixels that are inverted on each image.

15. A device according to claim 1, characterized by the fact that the addressing means are adapted to add a common voltage $V_M$ to all of the row and column signals.

16. A device according to claim 1, characterized by the fact that the addressing means are adapted to address a plurality of rows simultaneously using similar row signals that are offset in time for a duration greater than or equal to the time required for applying column voltages.

17. A device according to claim 1, characterized by the fact that the end of the column signals is synchronized on the end of the row signals.

18. A device according to claim 16, characterized by the fact that:

$$\tau_x \leqq \tau_D < \tau_L$$

in which relationship:

$\tau_D$ represents the time offset between two row signals;

$\tau_L$ represents the row addressing time comprising at least an anchoring breaking stage and a texture selection stage; and $\tau_c$ represents the duration of a column signal.

19. A device according to claim 1, characterized by the fact that the control signals include at least a first step during which the signals are adapted to switch at least one packet of pixels, preferably row pixels, collectively into the same state.

20. A device according to claim 19, characterized by the fact that the signals of the first step are adapted to switch the packet of preferably row pixels into a state that is "difficult".

21. A device according to claim 19, characterized by the fact that the signals of the first step present a sloping rising edge.

22. A device according to claim 19, characterized by the fact that the control signals include a second step during which the entire display is addressed in multiplexed mode in order to switch each pixel into a selected respective state.

23. A device according to claim 19, characterized by the fact that the signals of the second step are adapted to switch certain selected pixels, preferably rows, into an easy state.

24. A device according to claim 19, characterized by the fact that the signals of the second step present a rising edge that slopes.

25. A device according to claim 19, characterized by the fact that the signals of the first step are applied simultaneously to all of the pixels, preferably rows.

26. A device according to claim 1, characterized by the fact that the descending edge of a pixel signal selection stage is formed by a rectilinear ramp to obtain a uniform state.

27. A device according to claim 1, characterized by the fact that the descending edge of a pixel signal selection stage is formed by a squarewave signal having a single intermediate level for obtaining a uniform state.

28. A device according to claim 1, characterized by the fact that the descending edge of a pixel signal selection stage is formed by a squarewave signal having two successive levels for obtaining a uniform state.

29. A device according to claim 1, characterized by the fact that the descending edge of a pixel signal selection stage is formed by a signal comprising an intermediate level followed by a descending ramp, itself followed by an abrupt descending edge to obtain a uniform state.

30. A device according to claim 1, characterized by the fact that the descending edge of a pixel signal selection stage is formed by a squarewave signal having three successive levels to obtain a uniform state.

31. A device according to claim 1, characterized by the fact that the descending edge of a pixel signal selection stage is formed by an abrupt edge to obtain a twisted state.

32. A device according to claim 1, characterized by the fact that the descending edge of a pixel signal selection stage is formed by a squarewave signal having a signal intermediate level for obtaining a twisted state.

33. A device according to claim 1, characterized by the fact that the descending edge of a pixel signal selection stage is formed by a squarewave signal having two successive levels, the second of these levels having an amplitude greater than the first in order to obtain a twisted state.

34. A device according to claim 1, characterized by the fact that the descending edge of a pixel signal selection stage is formed by a signal having an intermediate level followed by a rising ramp, itself followed by an abrupt descending edge in order to obtain a twisted state.

35. A device according to claim 1, characterized by the fact that the descending edge of a pixel signal selection stage is formed by a squarewave signal having three successive levels of respective increasing amplitude from one level to the following level in order to obtain a twisted state.

36. A device according to claim 1, characterized by the fact that the addressing means (56) are adapted to generate row signals comprising a sloping rising edge and a squarewave descending edge including a single intermediate level.

37. A device according to claim 1, characterized by the fact that the addressing means (56) are adapted to generate row signals comprising a sloping rising edge followed by a level to break anchoring, a sloping descending edge followed by a level, and a sudden drop for selection purposes.

38. A device according to claim 1, characterized by the fact that the addressing means (56) are adapted to generate column signals in the form of single squarewave pulses.

39. A device according to claim 1, characterized by the fact that the addressing means (56) are adapted to generate column signals in the form of signals each having a sloping rising edge and an abrupt descending edge.

40. A device according to claim 1, characterized by the fact that the addressing means (56) are adapted to generate column signals in the form of squarewave signals having two levels, the second level being of greater amplitude than the first.

41. A device according to claim 1, characterized by the fact that the addressing means (56) are adapted to generate column signals each in the form of a pulse having a sloping rising edge, and a level which terminates in an abrupt descending edge.

42. A device according to claim 1, characterized by the fact that said device comprises a plurality of pixels in form of a matrix of rows and columns, said control signals correspond to the difference of voltage between row pulses and column signals and the addressing means (56) comprise analog switches (Col to Col0) adapted to generate a row signal for switching one out of two voltages VL(t) or 0V, and for generating a column signal to switch one out of three voltages +C(t), −C(t), or 0V.

43. A device according to claim 42, characterized by the fact that the addressing means (56) comprise a number of analog switches equal to twice the number of rows plus three times the number of columns.

44. A device according to claim 42, characterized by the fact that the analog switches are fed with time-varying analog signals (VL(t), +C(t), and −C(t)).

45. A device according to claim 42, characterized by the fact that the addressing means (56) comprise analog switches powered by constant voltages (V1, V2, +C, $V_o$+C, −C, $V_o$−C).

46. A device according to claim 1, characterized by the fact that the addressing means (56) comprise, for each row, a control circuit comprising two complementary transistors (60,62) whose main conduction paths are connected in series between ground and a power supply terminal (64) capable of receiving the voltages V1 or V2 in alternation.

47. A device according to claim 46, characterized by the fact that the power supply terminal (64) receives the voltages V1 and V2 for positive signals and the voltages 0V and V1-V2 for negative signals.

48. A device according to claim 1, characterized by the fact that the addressing means (56) comprise, for each column:

a control circuit having three transistors (70, 72, 78), two of the transistors (70, 72) having main conduction paths connected in series between a power supply terminal (74) suitable for receiving the voltages +C or $V_o$+C in alternation, and a power supply terminal (76) suitable for receiving the voltages −C or $V_o$−C in alternation, and a third transistor (78) whose main conduction path is placed between the common point of the two above-mentioned transistors (70, 72) and a power supply terminal (79) suitable for receiving the voltages 0V and $V_o$ in alternation.

49. A method of electrically controlling a bistable nematic liquid crystal matrix screen with breaking of anchoring, the method being characterized in that it comprises generating and applying addressing and control signals to the matrix screen, which signals include sloping rising edges presenting a gradient lying in the range of 0.1 V/μs to 0.005 V/μs and a duration greater than 300 μs, said step of generating signals comprising two stages:

a first stage for breaking anchoring, and a second stage for selection purposes, and in order to obtain a uniform texture, said step of generating signals being further adapted to generate signals for which the drop between two successive levels in the descending edge of the selection stage does not exceed a critical threshold value ΔV, while for obtaining a twisted texture, the descending edge includes at least one sudden drop greater than the critical threshold value ΔV.

* * * * *

UNITED STATES PATENT AND TRADEMARK OFFICE

CERTIFICATE OF CORRECTION

PATENT NO. : 7,724,221 B2
APPLICATION NO. : 10/545940
DATED : May 25, 2010
INVENTOR(S) : Jacques Angele, Philippe Martinot-Lagarde and Romain Vercelletto It is certified that error appears in the above-identified patent and that said Letters Patent is hereby corrected as shown below:

In the Claims, Column 21, Claim 18, line 60, please delete "$\tau_x \leq \tau_D < \tau_L$" and insert -- $\tau_c \leq \tau_D < \tau_L$ --.

Signed and Sealed this
Twelfth Day of February, 2013

Teresa Stanek Rea
*Acting Director of the United States Patent and Trademark Office*